United States Patent [19]

Chapman et al.

[11] Patent Number: 5,052,423

[45] Date of Patent: Oct. 1, 1991

[54] HYDROCLEANING OF THE EXTERIOR SURFACE OF A PIPELINE TO REMOVE COATINGS

[75] Inventors: Gordon R. Chapman, Tofield; Charles M. Reid, Edmonton, both of Canada

[73] Assignee: CUPS, Inc., Edmonton, Canada

[21] Appl. No.: 197,142

[22] Filed: May 23, 1988

Related U.S. Application Data

[63] Continuation-in-part of Ser. No. 55,119, May 28, 1987, abandoned.

[51] Int. Cl.[5] ..... B08B 3/02

[52] U.S. Cl. ..... 134/174; 134/181; 134/183; 134/199; 134/200; 239/754

[58] Field of Search ..... 134/172, 173, 174, 180, 134/181, 183, 198, 199, 200; 239/754, 722

[56] References Cited

U.S. PATENT DOCUMENTS

| | | |
|---|---|---|
| 2,556,116 | 6/1951 | Smith . |
| 2,782,436 | 2/1957 | Tomer . |
| 2,790,230 | 4/1957 | Sobek . |
| 2,896,644 | 7/1959 | Emanuel . |
| 3,033,215 | 5/1962 | Miller . |
| 3,101,730 | 8/1963 | Harris et al. . |
| 3,135,272 | 6/1964 | Brollo . |
| 3,225,777 | 12/1965 | Shelton et al. . |
| 3,226,277 | 12/1965 | Masuda et al. . |
| 3,289,238 | 12/1966 | Sorenson et al. . |
| 3,306,310 | 2/1967 | Grant . |
| 3,407,099 | 10/1968 | Schell . |

(List continued on next page.)

FOREIGN PATENT DOCUMENTS

| | | |
|---|---|---|
| 988403 | 5/1976 | Canada . |
| 1043056 | 11/1978 | Canada . |
| 1080918 | 7/1980 | Canada . |
| 1131418 | 9/1982 | Canada . |
| 1211352 | 9/1986 | Canada . |
| 0105545 | 4/1984 | European Pat. Off. . |
| 0214841 | 3/1987 | European Pat. Off. . |
| 1516903 | 7/1978 | United Kingdom . |
| 2018626 | 10/1979 | United Kingdom . |

OTHER PUBLICATIONS

Canadian Ultra Pressure Services Inc.—Pipeline Industry Services (7 pages).
NLB Corp. (3 pages).
ADMAC (3 pages).
Butterworth Jetting System Inc. (4 pages).
CRC Crose International Inc. (4 pages).
Garneau Pipeline Equipment Corp. Ltd. (10 pages).
Instromet Tartarini International, (5 pp.).

*Primary Examiner*—Frankie L. Stinson
*Attorney, Agent, or Firm*—Richards, Medlock & Andrews

[57] ABSTRACT

Apparatus for the hydrocleaning of the exterior surface of a pipeline or the like includes a frame adapted to surround a portion of a pipeline and defining a longitudinal passage through which, in use, the pipeline extends. A plurality of liquid jet nozzles are mounted to the frame in spaced apart relation so as to surround, in use, said pipeline in circumferentially spaced apart relationship to one another with each nozzle in spaced relation to the pipeline exterior surface. Means for supplying high pressure liquid to the nozzles to cause liquid jets to be emitted from the nozzles are provided. The nozzles and the frame are adapted to move relative to the pipeline surface when in operation such that (i) the liquid jets from the nozzles impinge on the pipeline surface along prescribed paths located in an annular region extending around substantially the full circumferential extent of the pipeline and (ii) the annular region travels longitudinally relative to the pipeline to effect cleaning of the pipeline exterior surface. In one form of the machine the frame "opens" up to permit installation on an "in situ" pipeline.

26 Claims, 19 Drawing Sheets

U.S. PATENT DOCUMENTS 3,432,872 3/1969 Kirschke .
3,698,029 10/1972 Pulliam .
3,773,059 11/1973 Arneson .
3,933,519 1/1976 Koch et al. .
3,942,565 3/1976 Ratelle et al. .
3,994,766 11/1976 Dedels .
4,013,518 3/1977 Miko .
4,125,119 11/1978 Haas .
4,146,406 3/1979 Sampsell .
4,161,956 7/1979 Hadgkiss .
4,185,359 1/1980 Niccols .
4,205,694 6/1980 Thompson et al. .
4,219,155 8/1980 Goerss .
4,225,362 9/1980 Sentell .
4,231,239 11/1980 Lazaroff .
4,237,913 12/1980 Maasberg .
4,244,524 1/1981 Wellings .
4,337,784 7/1982 Goerss .
4,376,443 3/1983 Mondy, Jr. .
4,443,271 4/1984 Goerss .
4,460,005 7/1984 Rodger .
4,509,544 4/1985 Mains, Jr. .
4,552,594 11/1985 van Voskuilen .
4,677,998 7/1987 van Voskuilen .
4,718,439 1/1988 Gorra et al. .
4,788,993 12/1988 Beer et al. .
4,809,720 3/1989 Heraty .
4,811,902 3/1989 Nagata .

HYDROCLEANING OF THE EXTERIOR SURFACE OF A PIPELINE TO REMOVE COATINGS

BACKGROUND AND SUMMARY OF THE INVENTION

This invention relates generally to the hydrocleaning of a pipeline or the like to remove coatings and miscellaneous contaminants from the pipeline exterior surface.

Oil and gas transmission pipelines of large diameter (12"-60-) are usually coated and then buried before being used for transportation of fluids. The coatings serve to reduce corrosion caused by the various soils encountered.

The coating may be put on the pipe after it has been welded together in sections and before the welded line is buried. The coating process is usually continuous. In an alternate case the pipe sections are delivered to the site already shop coated except for 1'-2' on each end. Then another coating is applied to cover the previously uncoated ends of each section after the welding and before the whole line is buried.

In recent developments several pipeline operators have experienced underground failures of old coatings. These failures comprise disbondments between parts of the coating and the pipe which have occurred for various reasons. Despite the continuous use of cathodic protection the sites are conducive to pitting corrosion and to stress corrosion cracking (SCC) and, in severe cases, pipe failures have occurred under pressure. The situation has prompted many operators to initiate coating rehabilitation projects. Almost all SCC cases have been encountered in lines in the ground for 10 years or more.

For rehabilitation, the coated line must be uncovered, pulled up out of the ground and suspended, thoroughly cleaned of all of the old coating, inspected, re-coated and re-buried.

One most recent project in Canada was a program to rehabilitate many miles of a 36" OD gas pipeline. The equipment that has been used to date to remove the old coatings has not performed well enough to meet the operator's time schedule. The technique employs a self-propelled device fitted around the pipe which continuously cuts, scrapes and brushes the coating with steel knives and brushes. This method does remove some of the oldest coal tar coatings fairly well but performs unsatisfactorily on the polyethylene tape layered coatings of more recent vintage. The process leaves adhesive and tape residue and the knives can seriously damage the pipe surface. This machine has been around for approximately 20 years.

A general objective of the invention is to provide method and apparatus for the hydrocleaning of a pipeline, to effect pipe coating removal to thereby clean the pipe surface prior to grit blasting or alternatively to effect cleaning of the pipe surface to "near white" or "white" condition in preparation for subsequent re-coating.

A more specific objective is to provide an ultra high pressure water jetting system to effect removal of pipeline coatings and to achieve cleaning of the pipe surface in a continuous one-pass operation, which cleaning operation would precede the surface preparation (grit or shot blast) and re-coating processes.

A further objective is to provide a hydrocleaning system capable of replacing conventional coating removal systems utilizing knives and/or brushes and the like and which system in particular is capable of removing coatings of plastic tapes made of polyethylene, fusion bond epoxies and the like.

Some additional specific objectives are to provide:

(1) a self-propelled cleaning unit which can be remotely controlled for optimization of cleaning rates and personnel safety.

(2) adjustable cleaning means to permit of pipelines or pipes ranging in size from 12" OD to about 60" OD.

(3) a hydrocleaning method that does not require spinning of the pipe as it is being cleaned.

(4) a hydrocleaning system that can use the pipeline itself as a "monorail" for linear travel therealong and while the pipeline is "in situ" or out of the ground as desired.

(5) a hydrocleaning system that is capable of removing a wide variety of coatings commonly used on pipelines while containing the removed coatings and permitting their disposal in a safe environmentally acceptable fashion.

(6) a hydrocleaning system that is capable of working continuously in conjunction with and ahead of a pipeline re-coating machine.

Accordingly, in one aspect, the invention provides apparatus for the hydrocleaning of the exterior surface of a pipeline or the like including a frame adapted to surround a portion of a pipeline and defining a longitudinal passage through which, in use, the pipeline extends. A plurality of liquid jet nozzle means are mounted to said frame in spaced apart relation so as to surround, in use, said pipeline in circumferentially spaced apart relationship to one another and with each said nozzle means in spaced relation to the pipeline exterior surface. Means for supplying high pressure liquid to said nozzle means to cause liquid jets to be emitted from said nozzle means are provided. The nozzle means and the frame are adapted to move relative to the pipeline surface when in operation such that (i) the liquid jets from said nozzle means impinge on the pipeline surface along prescribed paths located in an annular region extending around substantially the full circumferential extent of the pipeline and (ii) the annular region travels longitudinally relative to the pipeline to effect cleaning of the pipeline exterior surface.

The nozzle means are in another aspect of the invention mounted to said frame for rotation about rotation axes which, in use, are generally normal to the pipeline exterior surface.

Means on said frame may be provided for supporting the latter on said pipeline and in spaced relation to the pipeline surface and for moving the frame longitudinally of the pipeline.

Preferably, the means for supporting and moving the frame comprise wheel means mounted to said frame and adapted to engage the pipeline surface at circumferentially spaced apart intervals, and drive means for rotating said wheels to advance the frame along the pipeline.

Another major aspect of the invention concerns the fact that in many cases pipeline operators would prefer to remove the old coating of their pipeline "in situ". This means that they would not cut the line after excavating and would not lift it above ground. Instead they would simply excavate beside and beneath the line and then, with oil and/or other liquid products still inside the line, would remove and replace the old coating. For safety, however, the internal line pressure would be considerably reduced. The line would be supported ahead and behind the moving machine by wooden blocks called "skids".

In order to provide for "in situ" hydrocleaning, the invention in a further important aspect provides a machine that can be "opened up" and fitted down over the pipeline and then "closed" so that the spray nozzles are all reasonably evenly arranged circumferentially around the pipe's surface and radially spaced therefrom. The machine can easily be removed from the line by reversing the actions above described.

The nozzle means in a further aspect of the invention are arranged such that the prescribed paths along which said liquid jets impinge on the pipeline surface form a series of closely spaced overlapping convolutions. The nozzle means comprise rotary jet heads mounted to said frame that allow for the nozzles' rotation about said rotation axes and the nozzle means are preferably adjustably mounted to the frame to permit their radial locations to be varied to accommodate a variety of pipeline diameters and to provide a desired spacing between the pipeline surface and liquid jet emitting portions of said nozzle means.

Rotation of the rotary jet heads above the surface of the large steel pipes used for pipelines requires maintaining a consistent safe jet head to pipe spacing despite variations in pipe diameter (these can be up to 1% of diameter), out of roundness, dents and wrinkles in the pipe's surface. If not, serious damage could result. Hence, in a further aspect of the invention, a fixed clearance is achieved by suspending the rotary jet head assembly from the frame by means of a special hinged arrangement, typically a four bar linkage, that ensures that the jet head can move in a radial direction but will always stay in a constant alignment with respect to the pipe's axis. At the same time a hydraulic cylinder/accumulator system (well known per se in the art) maintains a compression on a guide wheel having a screw jack height adjustment which fixes the head to pipe clearance. Thus the rotating jet head will maintain a fixed relationship to the pipe's outer surface despite diametral dimensional variations and surface deformations that may be encountered.

The nozzle means typically comprise rotary jet heads having one or more nozzles. In the case of a single nozzle (i.e. producing a single water jet) if the nozzle arms are relatively long and their rotation speed is high then the rotating member needs to be dynamically balanced to avoid serious vibrations. The answer is to equip the head with two identical arms except that one of the two ends is plugged off with a blanked or plugged nozzle. Rotary jet heads with an odd number of operating jets greater than one would require a number of blanks inserted while maintaining geometric symmetry for ease of balancing the rotating member.

The means for supplying high pressure liquid preferably comprises a high pressure pump means and a prime mover, water storage means and flexible hose means connected between said pump means and said nozzle means to supply the high pressure liquid thereto. The high pressure pump, prime mover and water storage means are preferably mounted to means capable of travelling alongside the pipeline. The apparatus may also include means connected to said frame and supported from the ground for preventing rotation of said frame around the pipeline during the relative movement between the frame and the pipeline surface.

Many pipeline operators have lines that were coated in the past with materials which are environmentally unacceptable, for one reason or another. Some coatings contain varying percentages of materials such as asbestos, fiberglass and bituminous materials. In some instances these materials cannot be simply buried with the line or dumped on the ground after they have removed them with the water jets. They must be disposed in an approved disposal site.

Accordingly, in a further aspect of the invention, provision is made for containment and disposal of such waste material produced by the hydrocleaning process. Preferably, the whole machine is enclosed with a canopy of a suitable light material and a catchment sump is located beneath the machine. From the sump the slurry of water and coating debris can be pumped to disposal tankers using suitable vacuum pumps. In some cases the possibility exists for separating most of the water and cleaning it of solids and re-using it for hydrocleaning the pipeline.

Another feature of the invention concerns the fact that a pipeline operator has to excavate earth so as to expose the total circumference of the line with sufficient annular clearance beside and beneath the line for subsequent machines to pass. However, with some oil or gas products in the line under pressure, the use of a heavy bucket of a back hoe or the use of ditching scoops on a continuous ditch excavating machine could be dangerous since the pipe might be impacted by such moving equipment. A reasonably safe excavation procedure leaves a substantial amount of earth still to be removed from around the pipe by other safer means.

Accordingly, another feature of the invention provides means for washing away the residual earth from around the pipe. The hydrocleaning machine is made to function as an earth excavator by providing jet heads arranged so that the water jets are directed generally in a direction ahead of the machine to thus wash the earth residue from the line. Each jet head is rotated so as to achieve total coverage of the surface to be washed.

A further aspect of the invention provides a method for the hydrocleaning of the exterior surface of a pipeline or the like. The method includes positioning a plurality of liquid jet nozzle means around a pipeline in circumferentially spaced apart relation to one another and in preselected spaced relation to the pipeline exterior surface and supplying high pressure liquid to said nozzle means to cause emission of liquid jets from said nozzle means. These liquid jets are caused to impinge on the pipeline exterior surface along prescribed paths located in an annular region extending around substantially the full circumferential extent of the pipeline as said annular region of impingement moves relative to said pipeline longitudinally thereof to effect cleaning of the pipeline exterior surface.

The nozzle means in a further aspect of the invention rotates about axes normal to said pipeline surface with said liquid jets being emitted from said nozzle means in radially spaced relation to said rotation axes. The prescribed paths along which said liquid jets impinge on the pipeline surface form a series of closely spaced overlapping convolutions.

Further features and advantages of the invention will become apparent from the following description of preferred embodiments of same, reference being had to the accompanying drawings.

BRIEF DESCRIPTION OF THE VIEWS OF DRAWINGS

Figure 7:
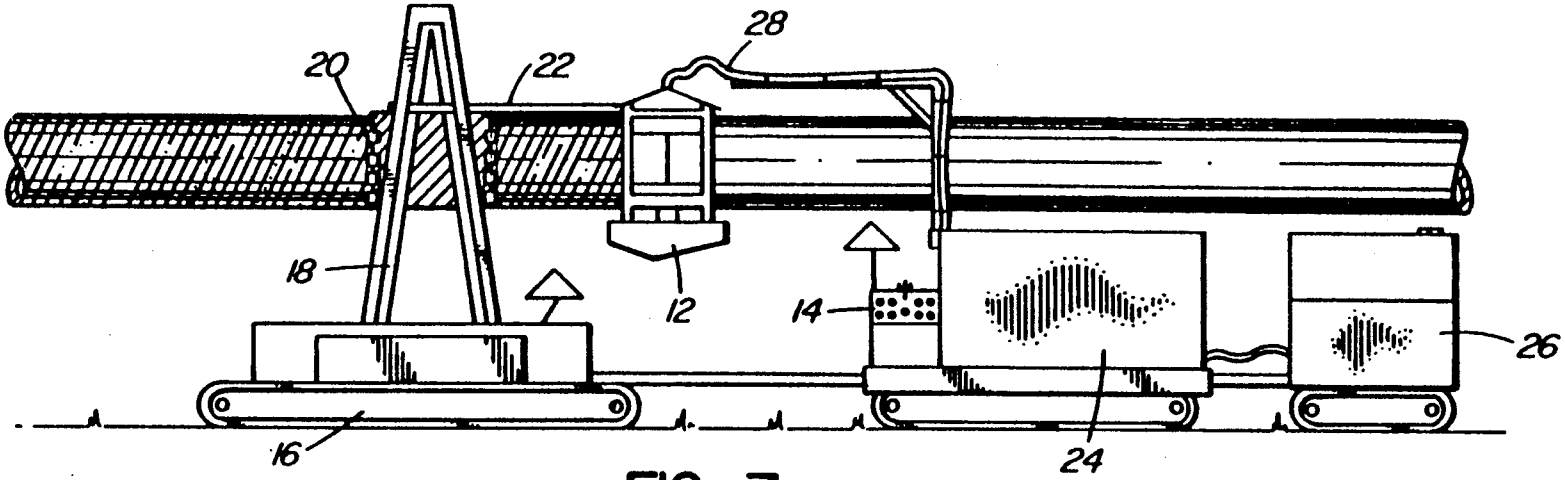
Figure 8:
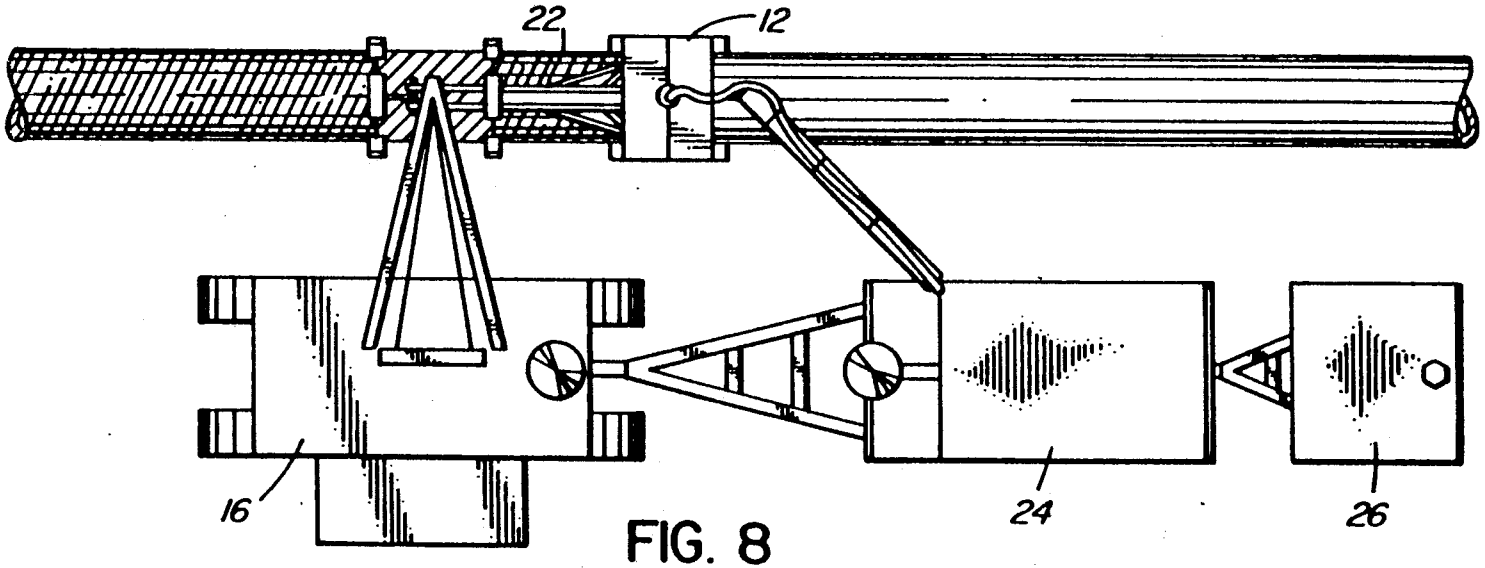
Figure 9:
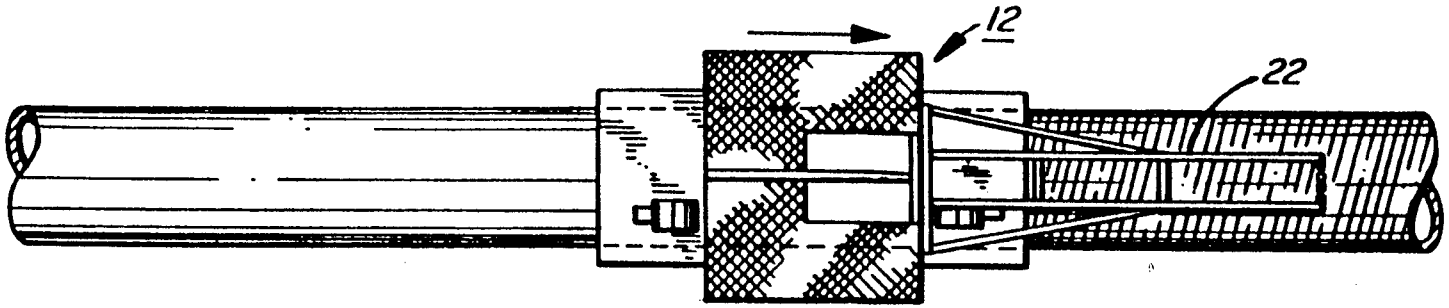
Figure 10:
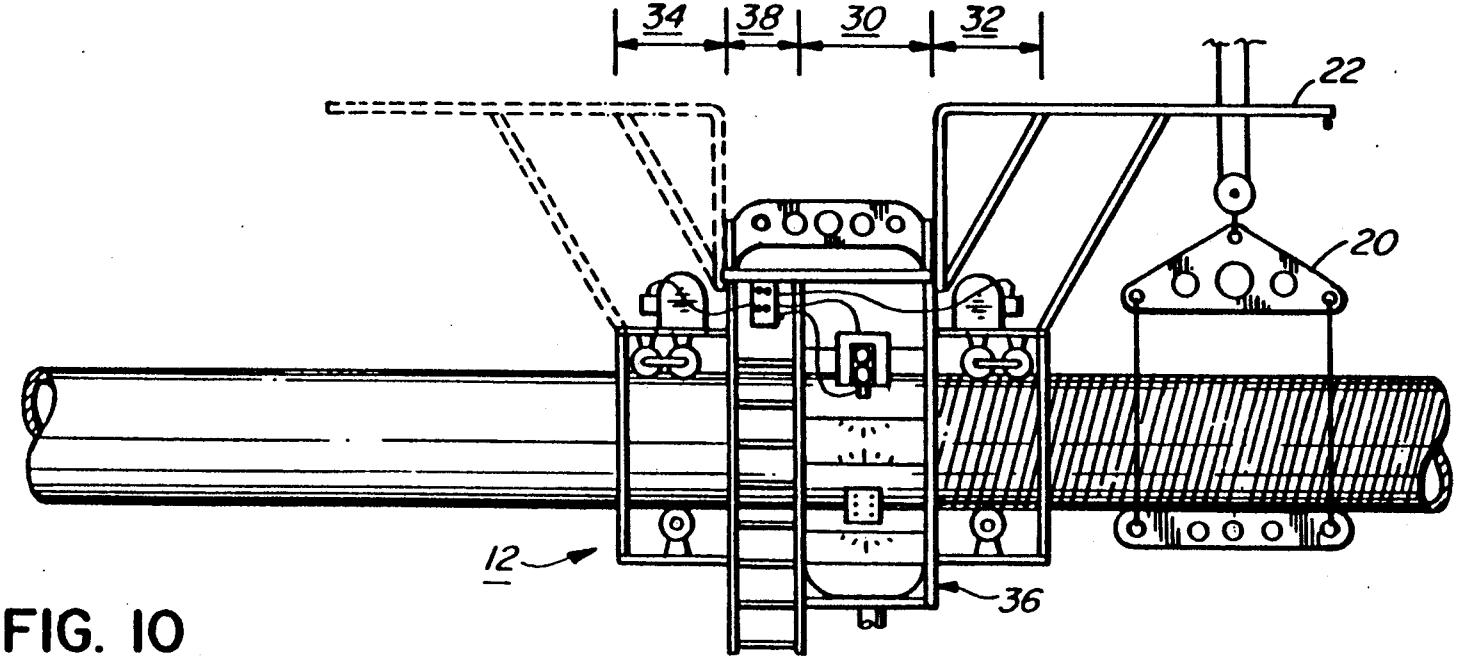
Figure 11:
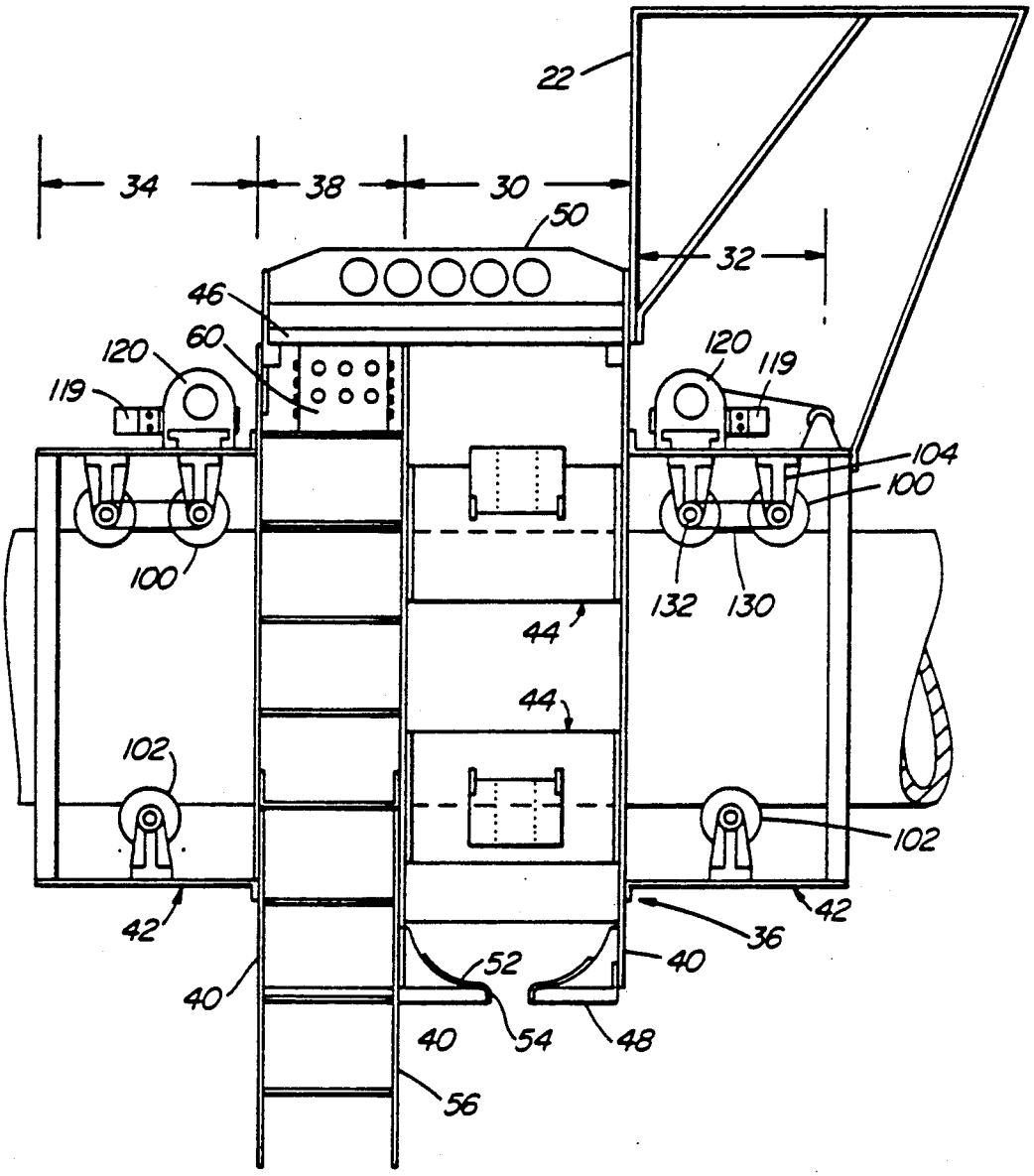
Figure 12:
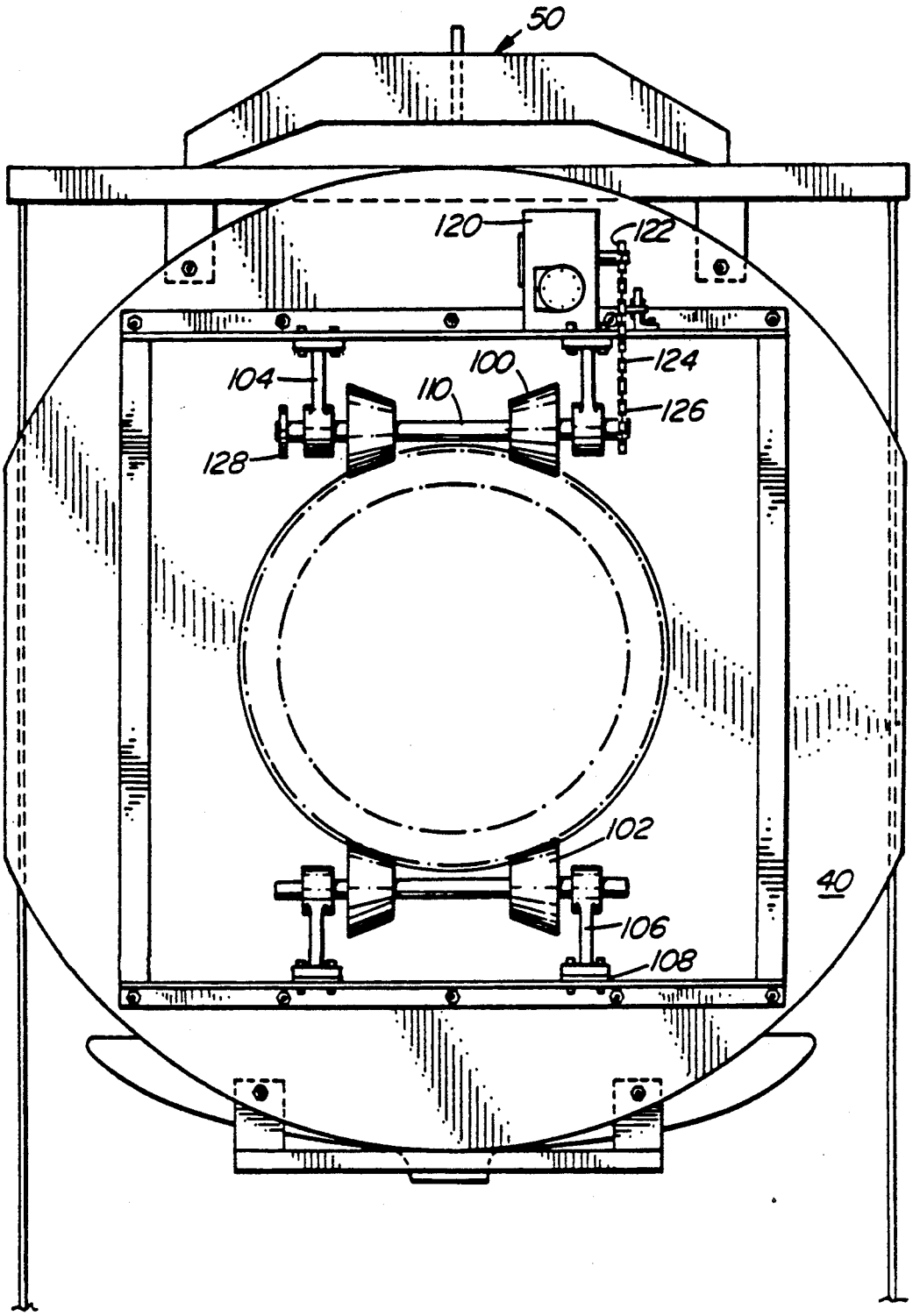
Figure 13:
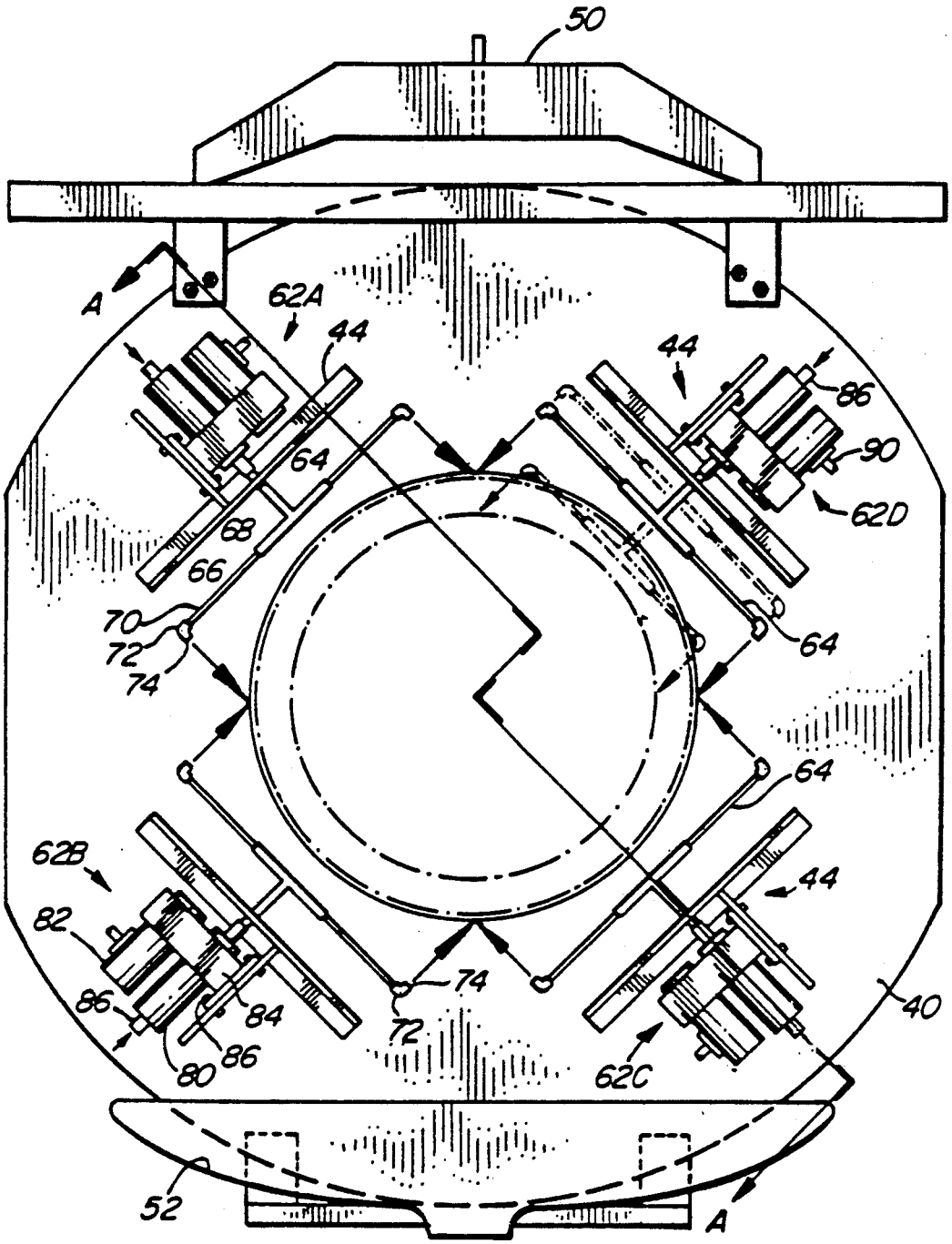
Figure 14:
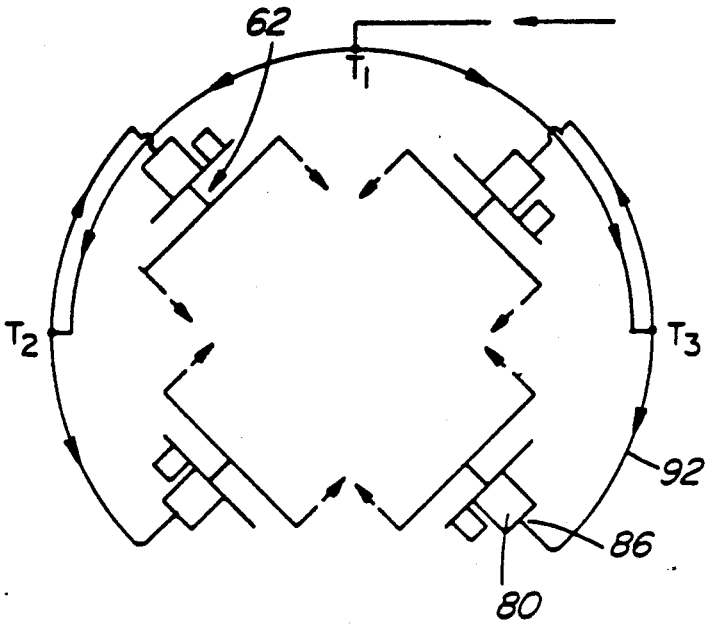
Figure 15:
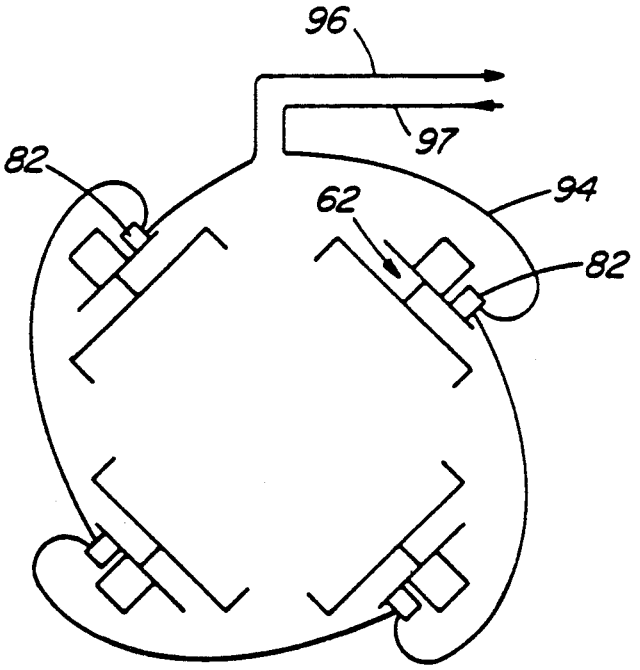
Figure 16:
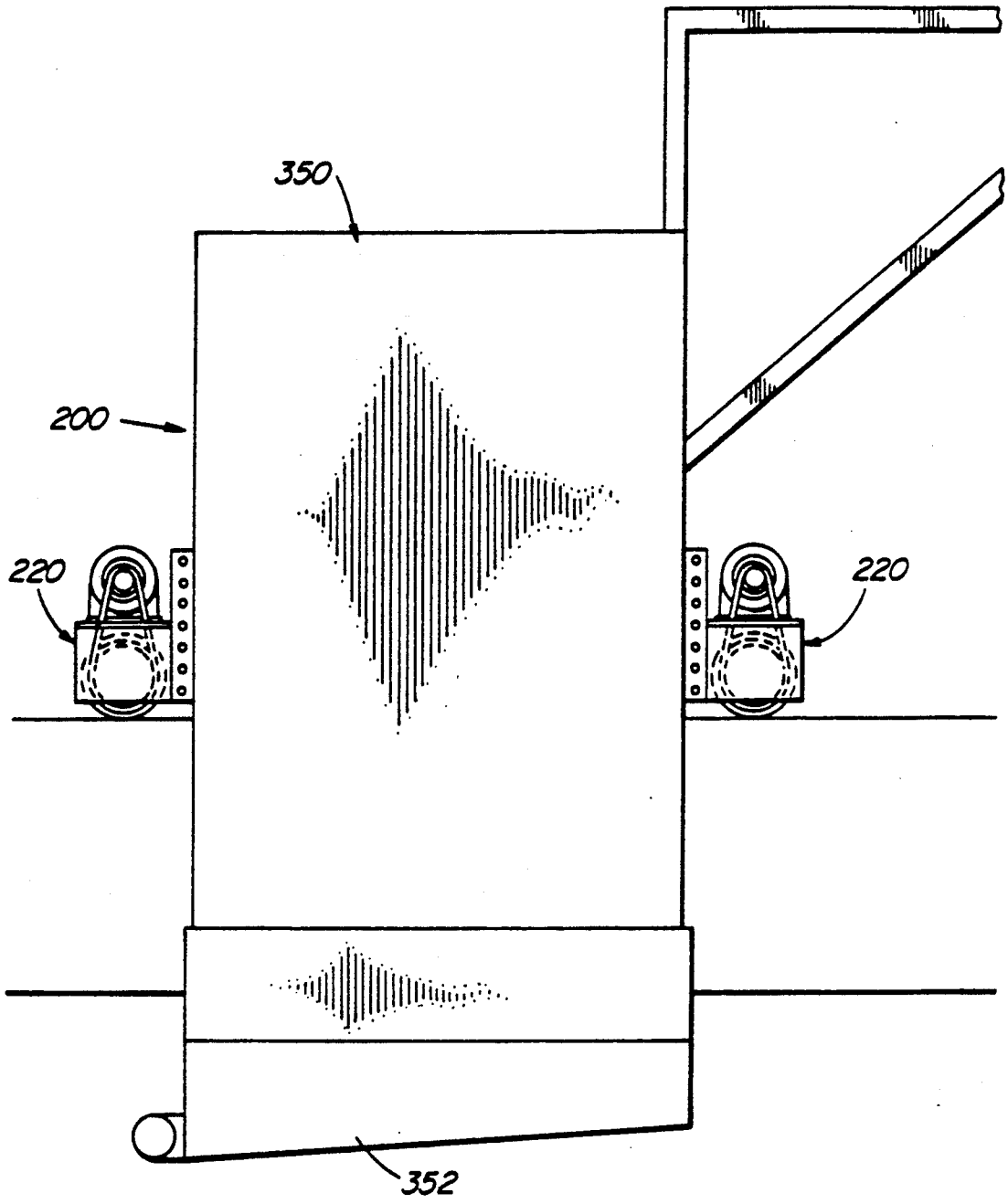
Figure 17:
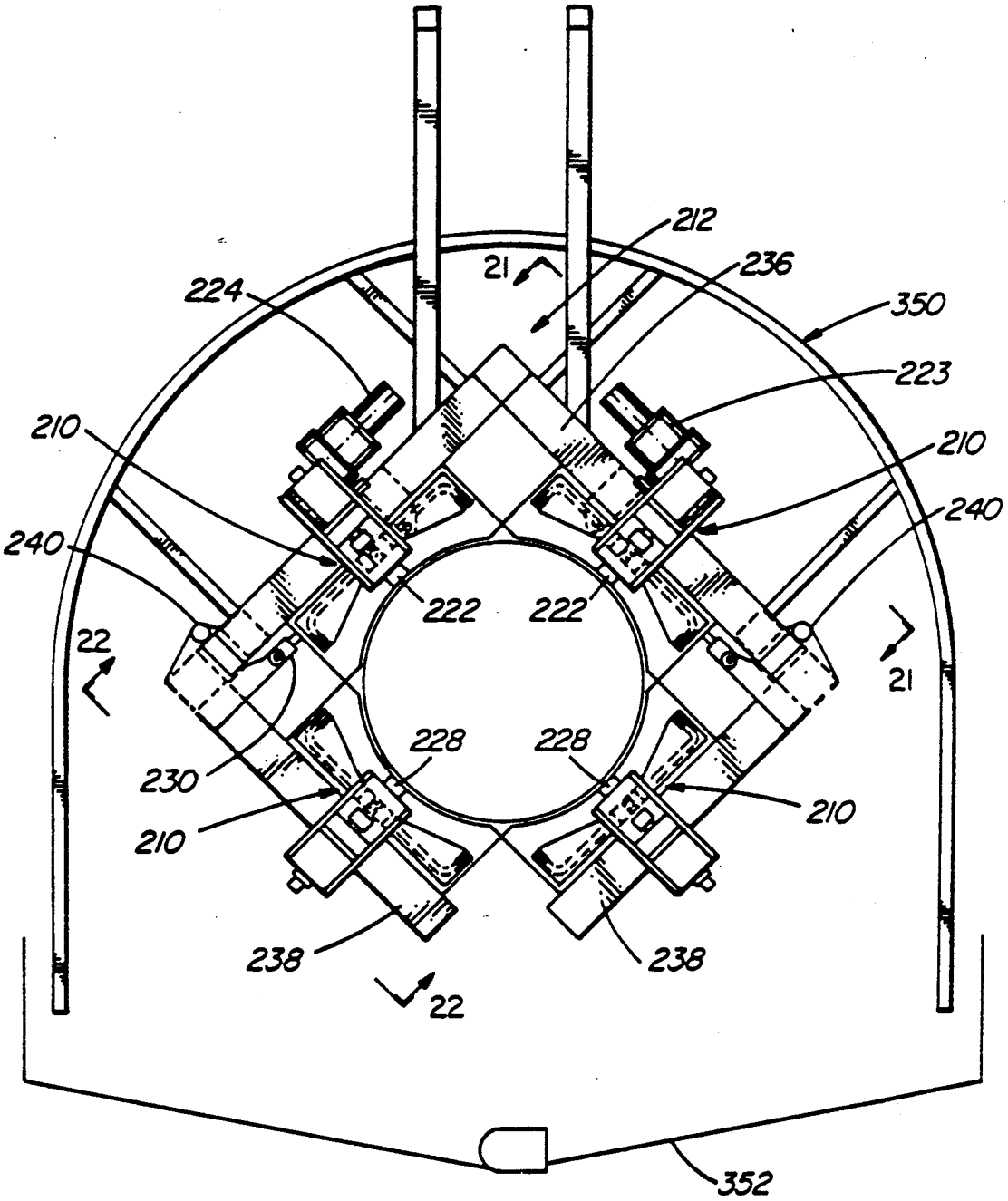
Figure 18:
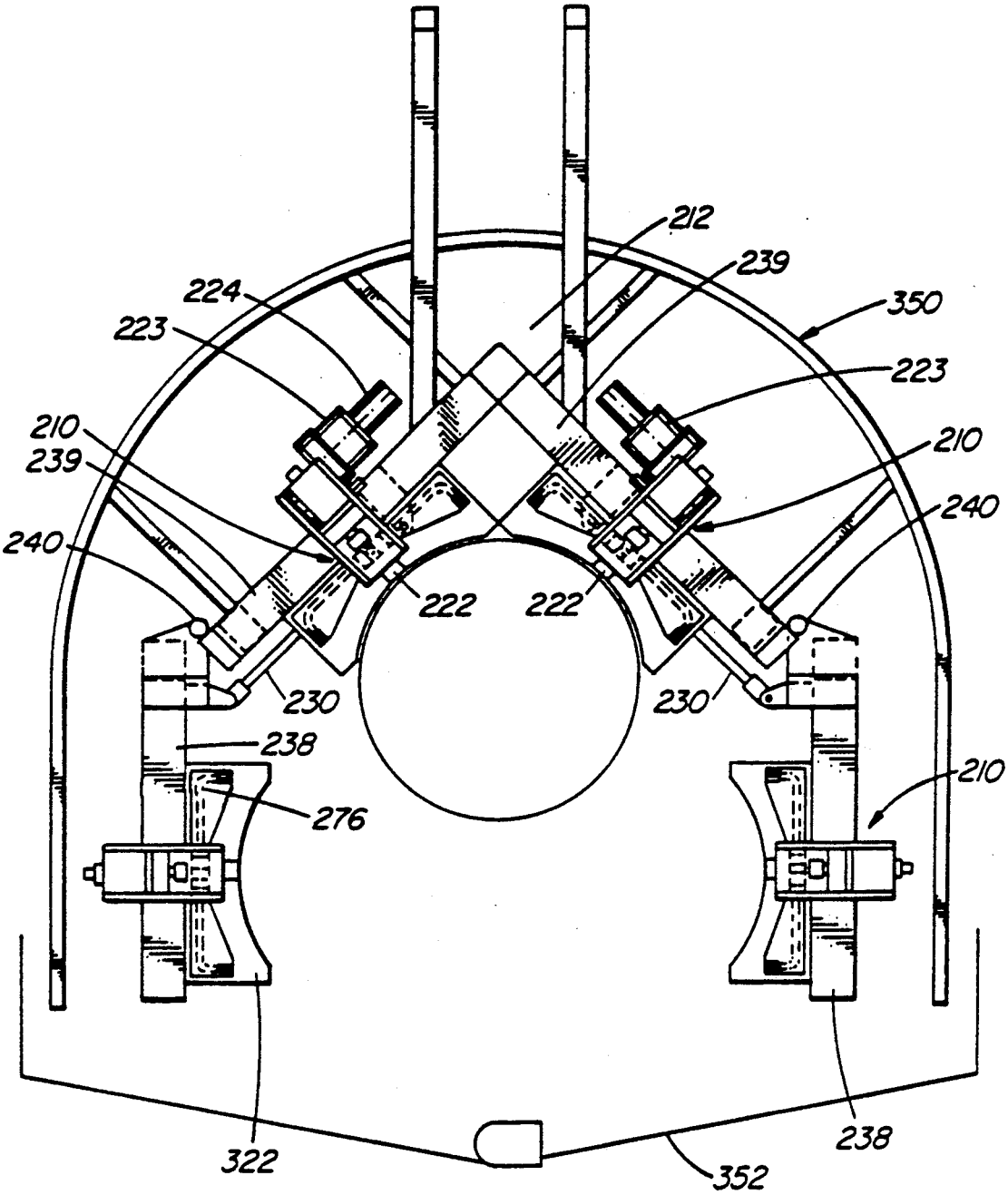
Figure 19:
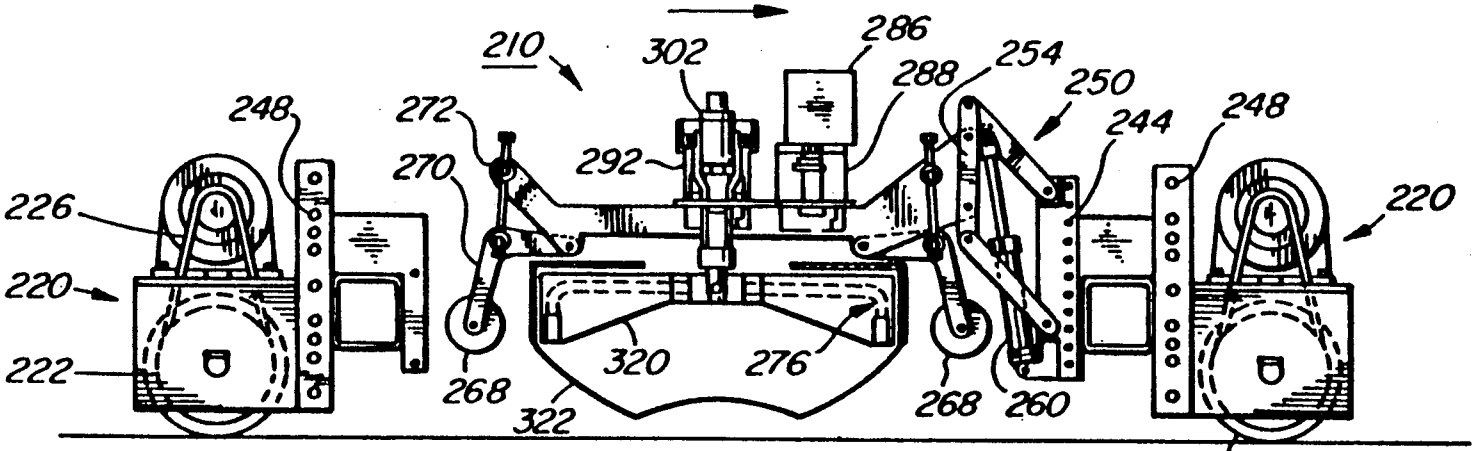
Figure 20:
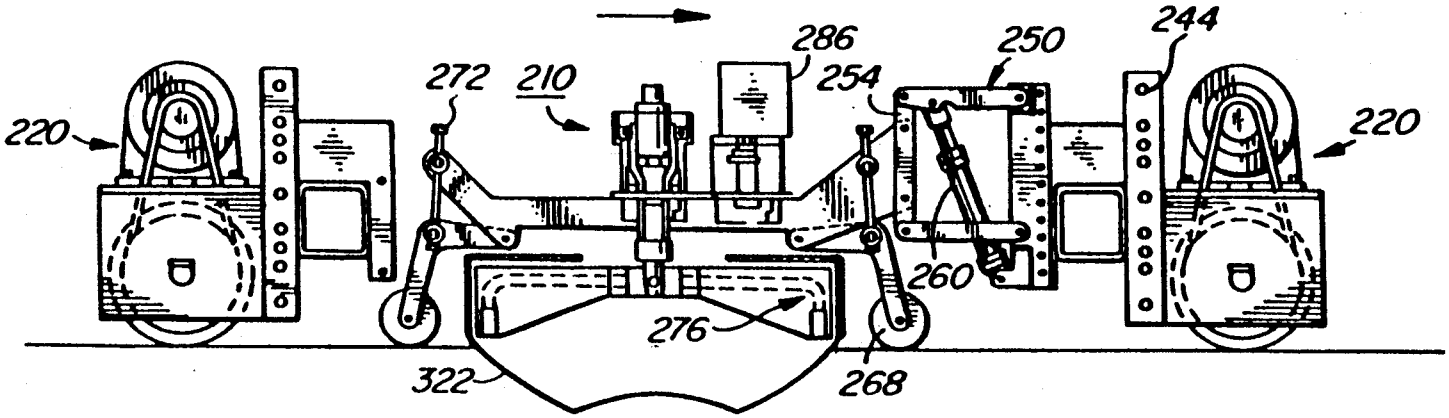
Figure 21:
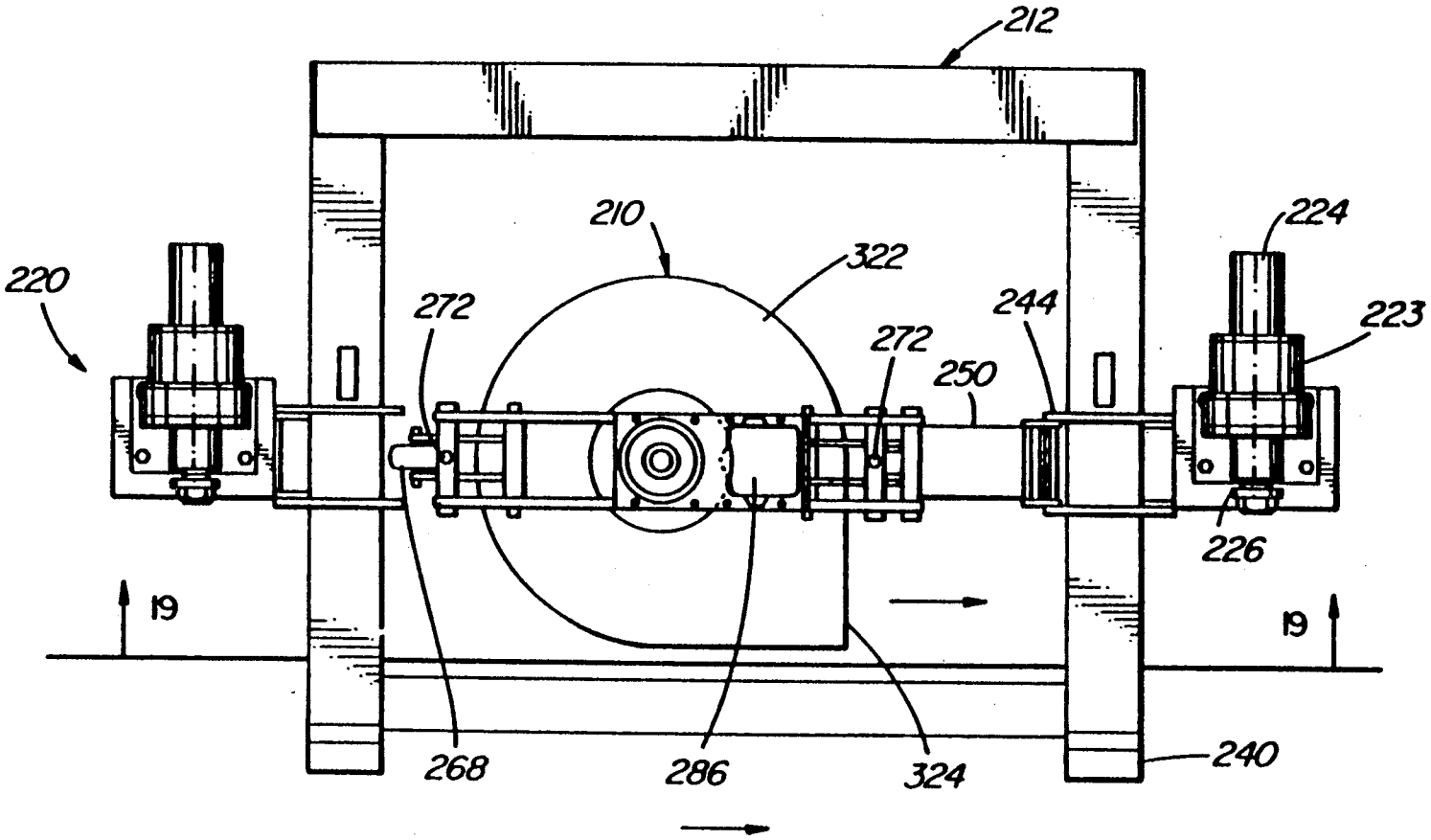
Figure 22:
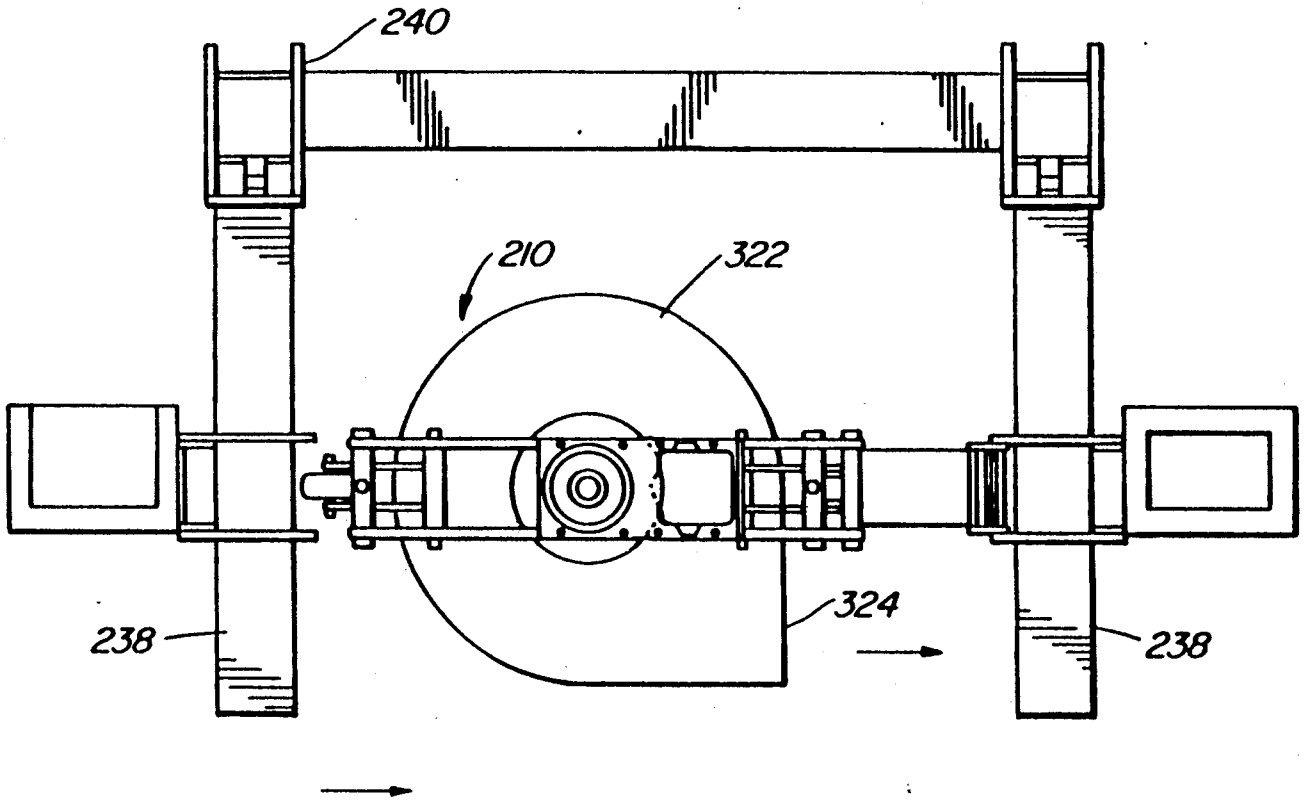
Figure 23:
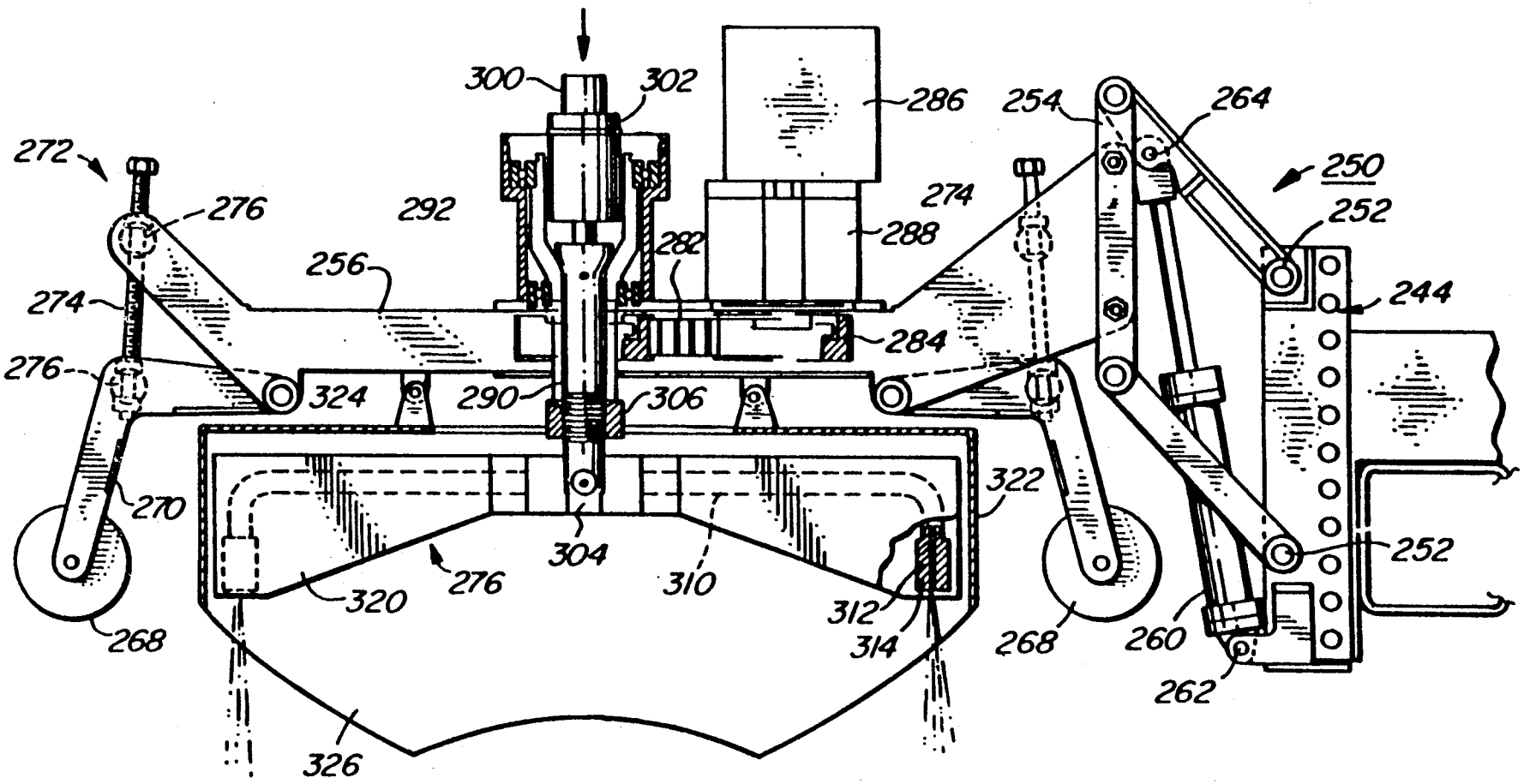
Figure 24:
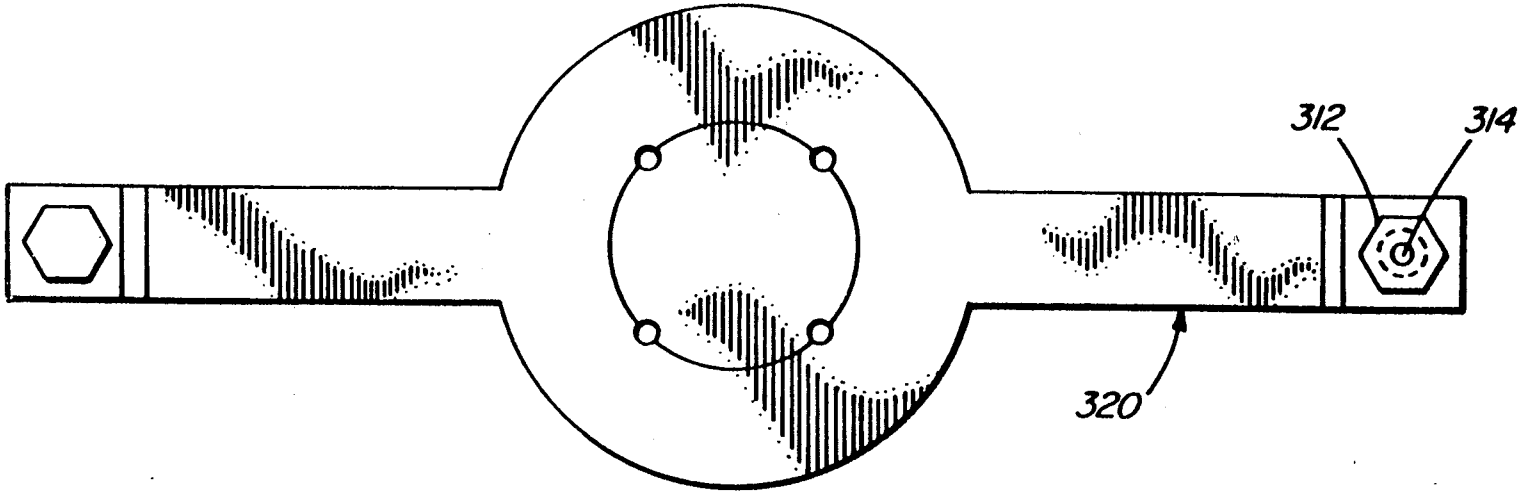
Figure 25:
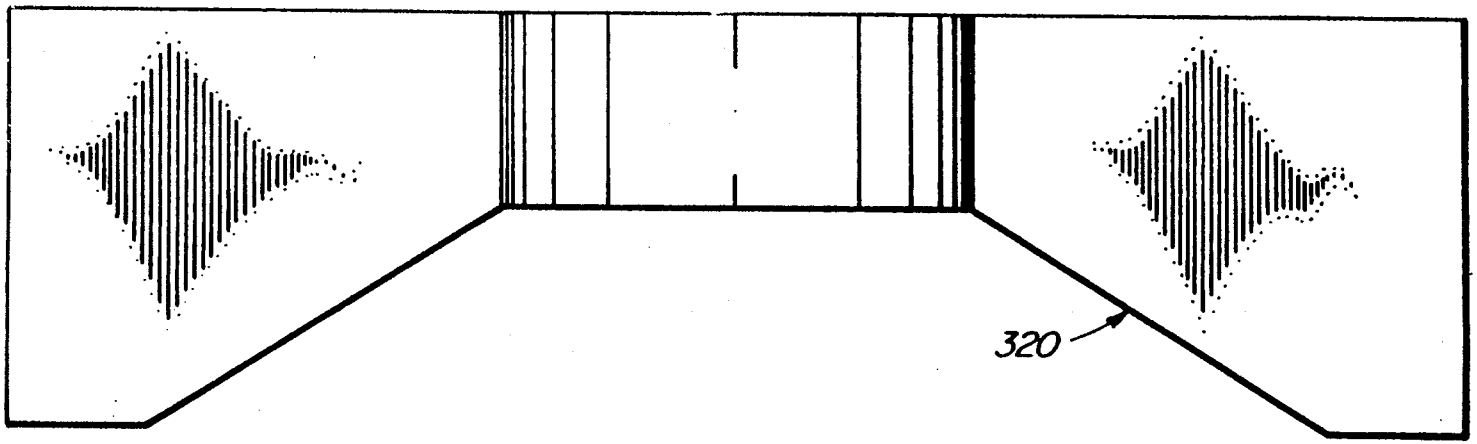
Figure 26:
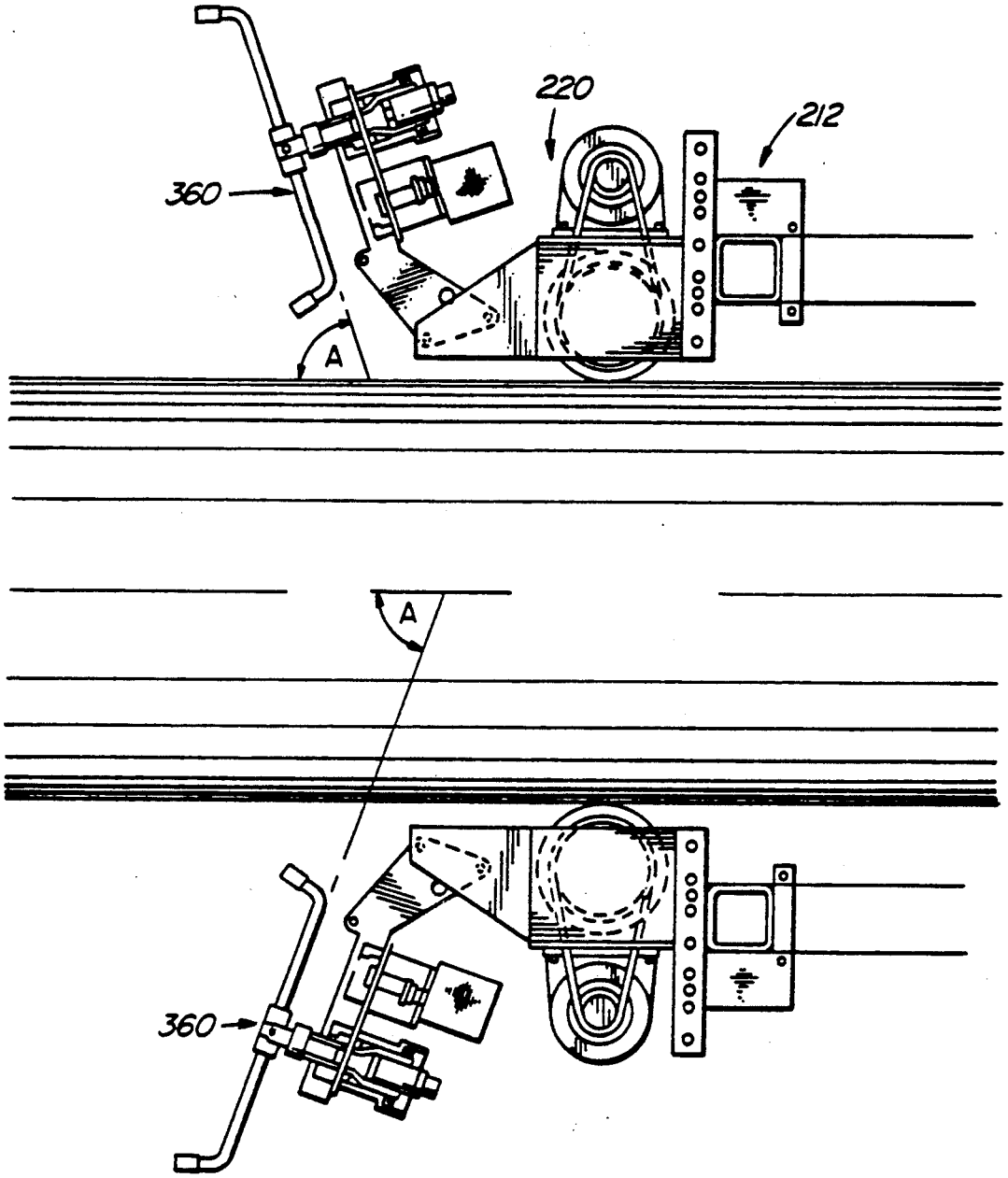
Figure 27:
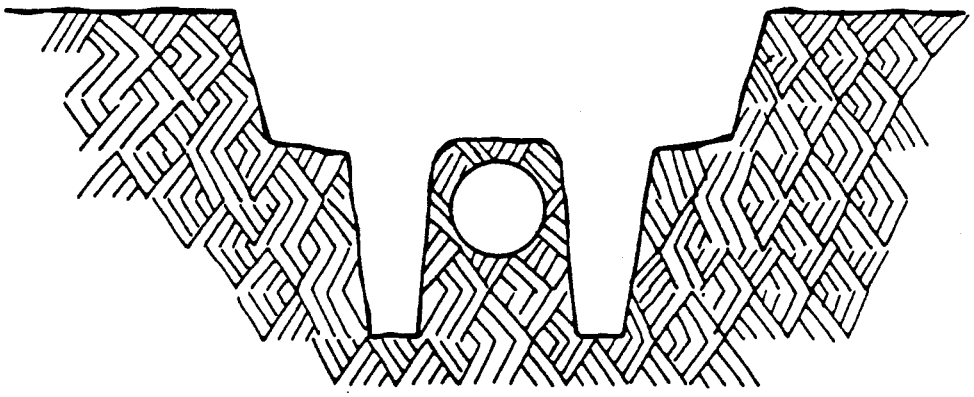
Figure 28:
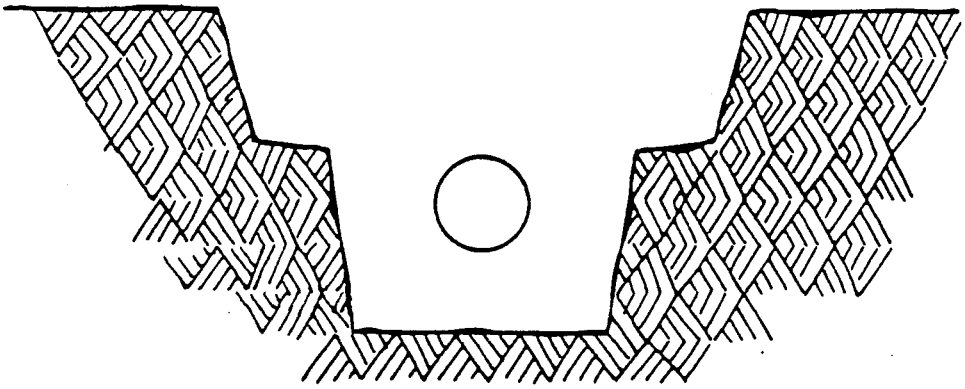

FIG. 6*a-d* shows photographs of water jets exiting from a nozzle at various pressures;

FIGS. 7 and 8 are side elevation and plan views respectively of a first embodiment of a complete pipeline hydrocleaning system for hydrocleaning of pipelines which have been excavated and lifted upwardly out of the trench;

FIGS. 9 and 10 are plan and side elevation views respectively of the first embodiment of the pipeline hydrocleaning assembly;

FIG. 11 is a side elevation view of the first embodiment of the hydrocleaning assembly frame;

FIG. 12 is an end view of the above noted hydrocleaning apparatus illustrating portions of the linear drive assembly;

FIG. 13 is a cross-section view taken through the water jetting section of the above noted hydrocleaning assembly;

FIG. 14 is a schematic diagram illustrating the high pressure water supply for the rotary jet assemblies;

FIG. 15 is a schematic diagram of the hydraulic circuit diagram for the hydraulic motors which drive the rotary jet heads;

FIG. 16 is a side elevation view of a second major embodiment of the invention capable of hydrocleaning a pipeline when "in situ";

FIGS. 17 and 18 are cross-section views of the embodiment of FIG. 16 showing how the frame "opens" to clear obstructions and for installation or removal of the apparatus to and from a continuous pipeline;

FIG. 19 is a section view along line 19—19 of FIG. 21 showing a cleaning module "raised" above the pipeline surface;

FIG. 20 is a view similar to FIG. 19 but showing a cleaning module in the "lowered" working position;

FIGS. 21 and 22 are views of the hydrocleaning apparatus along lines 21—21 and 22—22 of FIG. 17;

FIG. 23 is an enlarged view of one of the cleaning modules of the second major embodiment per se and the adjustment and linkage means associated therewith;

FIGS. 24 and 25 are plan and side elevation views respectively of a "paddle" assembly for use with each jet head;

FIG. 26 is a side elevation of a modification of the apparatus adapted for cleaning residual earth away from the pipeline;

FIG. 27 shows a pipeline after basic excavation with a backhoe showing residual earth around the pipeline; and FIG. 28 is a view similar to that of FIG. 27 but showing the pipeline after all residual earth has been cleared away.

DETAILED DESCRIPTION OF THE PREFERRED EMBODIMENTS

Figure 1:
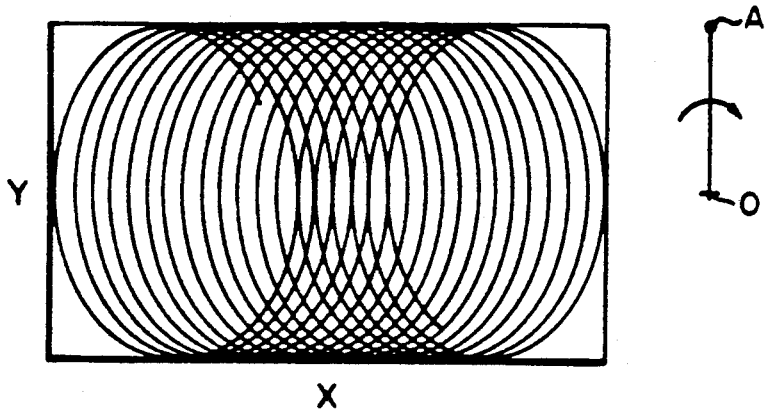
FIGS. 1-4 are X-Y plots of the paths described by various rotating nozzle configurations.

In order to understand the principles involved, reference will be had firstly to certain rotary water jetting patterns as shown in FIGS. 1 ∝ 4.

FIG. 1 is an X—Y plot showing the typical pattern of the path traced out on a flat surface by a single water jet A rotating around an axis 0. The lines simulate the trace of the center of impact of the jet. This pattern is for a given traverse speed and RPM at a fixed radius of rotation, i.e. 1000 RPM at a radius of 3.0 inches and a traverse speed of 8 inches per second.

Figure 2:
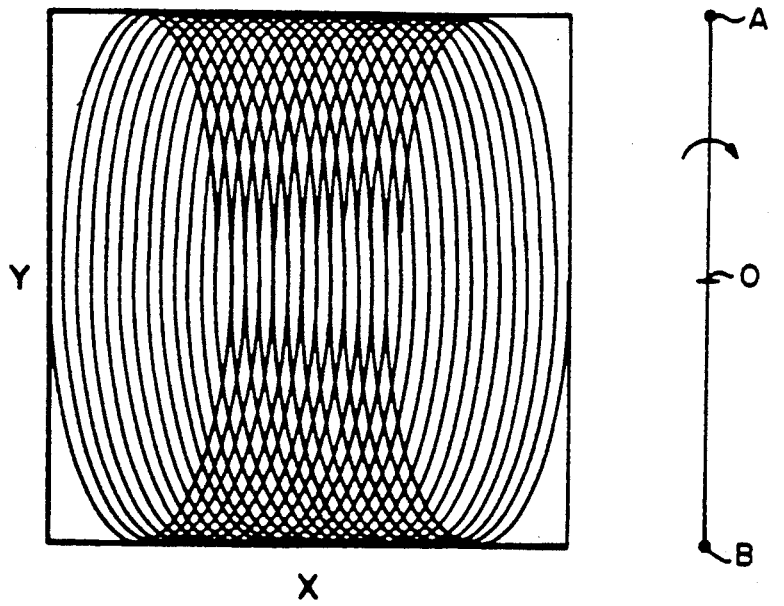

FIG. 2 shows a similar pattern for different conditions and in this case the pattern simulates the traces of two water jets A and B being 180° apart and rotating about axis 0.

Figure 3:
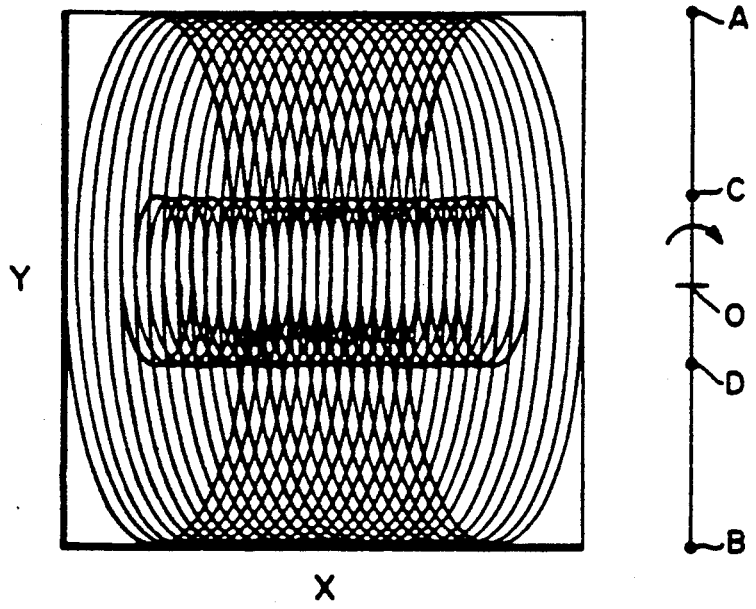

FIG. 3 illustrates a further pattern for a rotating, nozzle assembly including the same two outside nozzles A, B operating at the same RPM and traverse speed as in FIG. 2 but including two additional inside nozzles C and D which are disposed in line with the outer two nozzles A, B. Again, all of these nozzles are rotating about the axis 0.

Figure 4:
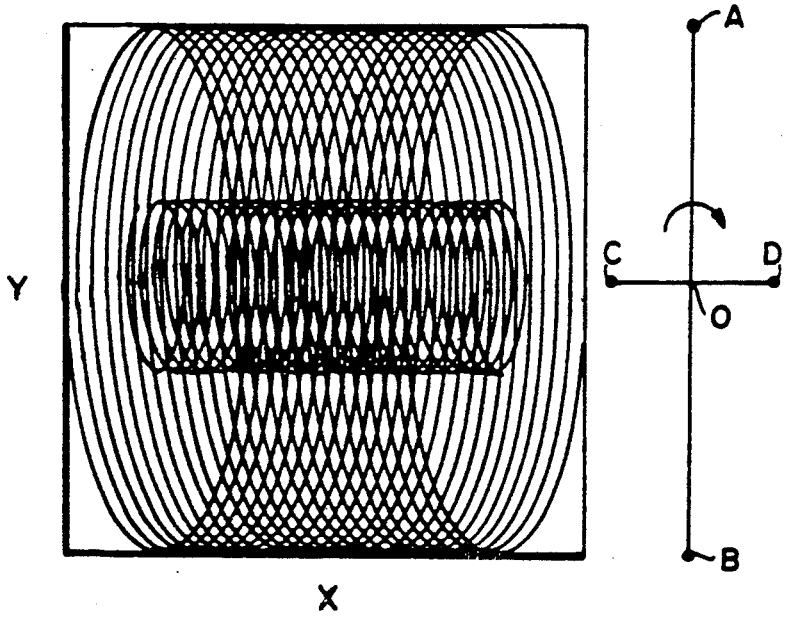

FIG. 4 illustrates a pattern similar to that of FIG. 3 except that in this case the inner nozzles C', D' are at 90° to a line connecting nozzles A, B.

These last two Figures show how the two inner nozzles will serve to more effectively clean the center area and that the C', D' nozzle positions produce better coverage than the C, D nozzle positions.

Figure 5:
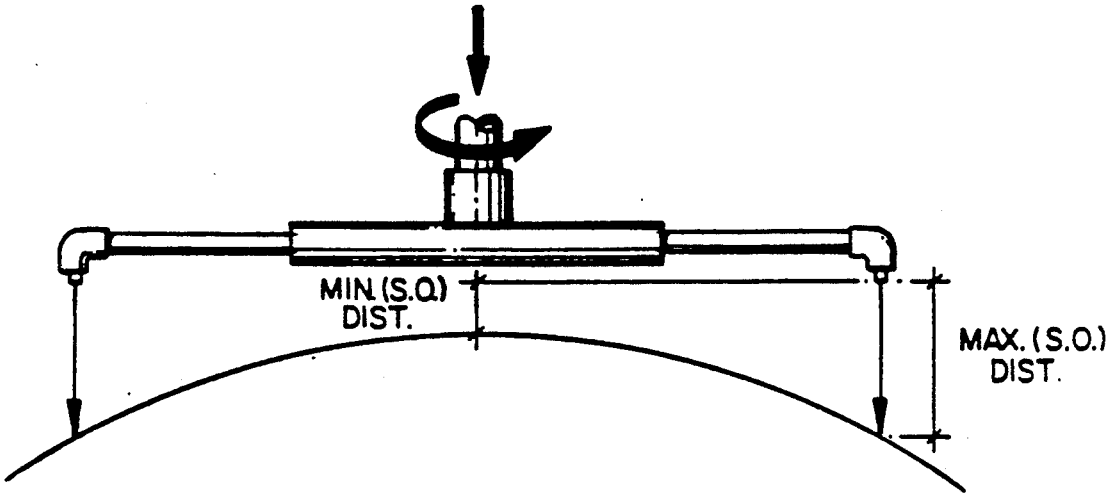
FIG. 5 is a diagrammatic view of a rotary nozzle showing the variation in stand-off distance when cleaning a pipe surface.
Figures 6A, 6B, 6C, 6D:
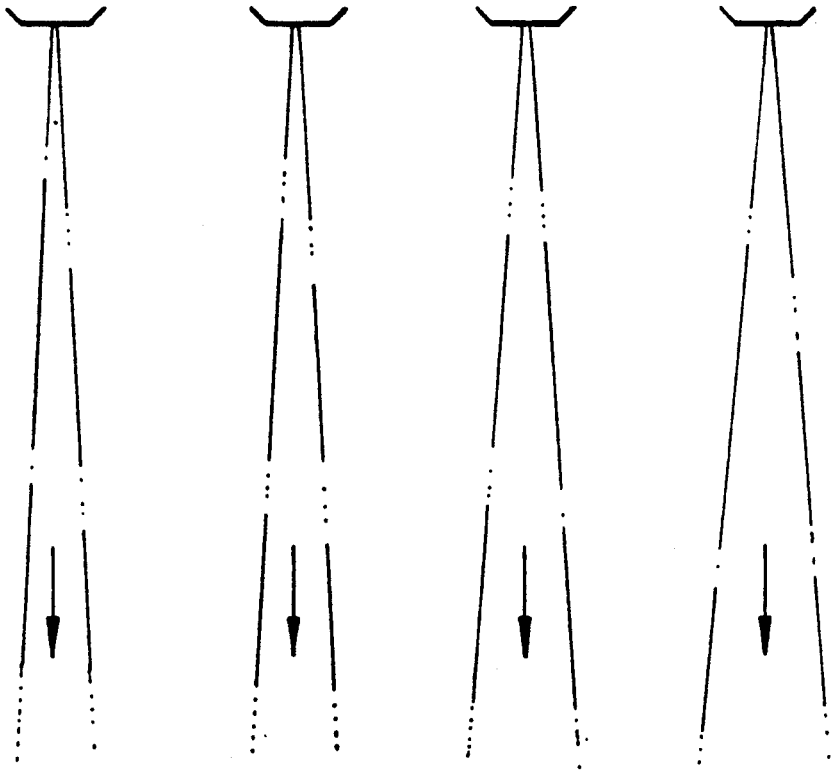

The patterns described above are those which would be described on a flat surface with the jet nozzles equidistant from any point on the surface throughout the rotation path. However, when the surface is curved (e.g. arcuate) as in the case where a coated pipeline surface is involved, the "stand-off" distance (the distance between the nozzle outlet and the surface) increases towards the two edges of the traverse being increasingly greater than at the center line on the top of the pipe, reference being had to FIG. 5. This would lead one to expect a variation in the degree of cleaning efficiency between the center area and the edges. Indeed this stand-off distance has been studied, reference being had to a paper entitled "The Influence of Stand-Off Distance On Cutting With High Velocity Fluid Jets" by N. C. Franz, Ph. D.—University of British Columbia, Canada, presented at the second International Symposium on Jet Cutting Technology, 2nd-4th April, 1974, held at St. Johns' College, Cambridge, England. Existing knowledge might lead one to expect a variation in the degree of cleaning effectiveness between the center area and the edges thus, logically, suggesting the use of non-rotating nozzles at a constant stand-off distance. They would oscillate along a helical arc at said constant stand off distance from the pipe's surface while moving linearly along the pipes. However, by studying the patterns of FIGS. 1-4, it can be seen that the cleaning paths are more concentrated toward the edges. This compensates for the increased stand-off distance toward the edges as seen in FIG. 5. This feature makes possible the use of rotating nozzle assemblies having rotation axes normal to the pipe surface and eliminates the need for more complex systems providing for circumferential motion so as to maintain a constant stand-off distance. In tests conducted to date it was found that the edges actually were cleaned off better than the center when cleaning tape coatings from a 36" OD pipe using a nozzle head having a 13.5" radius and two outer nozzles. If the axial traverse rate was set too high, streaks of tape residue appeared in the center of the traverse and these streaks ran perpendicular to the pipe's axis. The patterns in FIGS. 1 and 2 were confirmed in practice. In general, it can be said that by adjusting the linear speed (rate of traverse) and the rotational speed of the nozzle head, and, in many cases, changing the rotary jet head configuration, a desired degree of cleaning can be achieved.

In general, water jet pressure increases tend to result in a wider expansion of the jet droplets at any given distance from any one nozzle, reference being had to the above-noted technical paper by N. C. Franz as well as to FIG. 6 which comprises photographs of water jets exiting from a 0.010 inch diameter nozzle and illustrating dispersion at various pressures. From (a) to (d) the pressures are respectively, 8, 15, 25, and 35 KSI with an exposed jet length of approximately 6 inches. Nozzle exit diameters can be varied between the outer and inner nozzles so as to achieve a jet width in the center area capable of cleaning the center region as clean as at the edges. It is clear that several variables are involved but is apparent that optimization of cleaning rate can be achieved while employing two motions only, i.e. linear and rotary.

The advance, A, when rotating two nozzles at 180 degrees to each other is given by the formula:

$$A = \frac{(U12)}{2N},$$

if U=linear travel speed in FT/MIN, and N=Rotation speed of the pair of nozzles in revolution/min.

Thus a typical Advance, A (as established by experiments) would be:

A=0.048 inch,
When N=1000,
And U=8 FT/MIN,
and the number of nozzles=2.

This would indicate that each jet would be required to clean a kerf in the coating of at least 0.048 inch wide so that the entire surface would be cleaned.

Typically, the nozzle inside diameters, when using two nozzles, have been 0.025 in. to 0.030 in. and the value of A for successful removal is in the order of 1.5 times the nozzle in diameter. If A is too large, streaks of uncleaned coating remain on the surface.

Various types of rotary jet head configurations may be used. In all cases, symmetry is desirable for balancing purposes because fairly high rotational speeds (300–1000 RPM) are used for these applications. The rotary jet heads can have one or more nozzles. In the case of a single nozzle (i.e. producing a single water jet) when the arms are relatively long and their rotation speed is high hen the rotating member needs to be dynamically balanced to avoid serious vibrations. The head can be equipped with two identical arms except that one can plug off one of the two ends with a blanked or plugged nozzle. Rotary jet heads with an odd number of operating jets greater than one would require a number of blanks inserted while maintaining geometric symmetry for ease of balancing the rotating member. Rotary round heads (not shown) having 2, 4, 8, and 16 jets could be used. Arm-type heads could also be used and the number of arms can comprise 2, 4, 8, 16, and so on. Combination armed/round jet having 4, 8, 16, and 32 jets, as the case may be might be used. Long/short armed forms of jet heads, eg., jet heads having four jets, two radially outer jets and two radially inner jets with these two pairs of jets being arranged so that lines extending between them are at 90° to one another can also be used.

Any one of the above mentioned types of rotary jet head configurations could be used in conjunction with the present invention depending upon the coating to be removed, pipe size, desired degree of cleanliness, desired cleaning rates and horsepower and water availability.

THE FIRST EMBODIMENT

FIGS. 7 and 8 are side elevation and plan views respectively of a complete hydrocleaning system incorporating the principles of the present invention. The complete hydrocleaning system comprises all of the equipment required to carry out the pipeline coating removal and pipeline surface cleaning of a pipeline which has been excavated and lifted above the earth's surface. (An improved embodiment of the invention capable of "in-situ" cleaning will be described hereinafter.) With reference to FIGS. 7 and 8, the hydrocleaning assembly is identified by reference numeral 12 and it comprises that part of the machine which is fitted or assembled around the outside of the coated pipeline that is to be cleaned. The hydrocleaning assembly 12 is self-propelled along the pipeline by means to be described hereinafter.

The hydrocleaning assembly is associated with a number of pieces of supporting equipment including a side boom tractor 16 provided with crawler tracks capable of moving along the pipeline right-of-way. The boom tractor 16 may be of any conventional design as also is its boom 18, the outer end of which supports a conventional pipe cradle 20. The pipe cradle supports the coated pipe as the hydrocleaning system moves along the right-of-way. A conventional bridle 22 extending between the cradle 20 and the hydrocleaning assembly 12 prevents rotation of hydrocleaning assembly 12 around the pipeline during use. The side boom assembly is provided with a suitable hoist thereby to allow the cradle to be adjusted upwardly or downwardly as desired. Other pieces of supporting equipment comprise a water pump, a hydraulic pump, and a prime mover (diesel engine) all of which are preferably disposed in a self-contained unit 24 which is adapted to be connected to the side boom tractor and towed behind it along the right-of-way. A water supply tank 26 is likewise arranged so as to be towed behind the pumps and power source unit 24.

The hydrocleaning assembly 12 includes a control arrangement 14 which comprises all the necessary remote controls to operate the supply of high pressure water to the jets, the supply of hydraulic power to provide for rotation of the water jets and to provide for activation of the linear drive mechanisms. The control system also comprises the associated automatic sensing and shut-down mechanisms. Also included within the control system are the various connecting hoses 28 which comprises conduits and lines for high pressure water, hydraulic fluid and measurement and control circuits between the hydrocleaning assembly 12 and the remote controls 14.

The hydrocleaning assembly 12 will be further described with reference to FIGS. 9, 10, and 11. The hydrocleaning assembly comprises three major components, i.e. the water jetting section 30, the forward and rear linear drive sections 32 and 34, and the framework 36.

FIG. 10 is a side elevation view of the hydrocleaning assembly 12 showing the three major components noted above and illustrating also the cradle 20 which holds up the pipe and which is hooked through the bridle 22, the latter being a stabilizing framework which prevents the hydrocleaning assembly from moving circumferentially around the pipe during operation.

FIG. 9 is a plan view of the hydrocleaning assembly, the cradle 20 being omitted.

The water jetting section 30 is essentially supported on its fore-and-aft sides by the linear drive sections 32 and 34, the latter including crawler wheels and drive means to be described hereinafter.

The framework 36 holds everything together and includes a means for lifting, a debris and water collection tray below the water jetting section, and a ladder on each side for use by the operators. The framework 36 supports the bridle structure 22. The bridle structure is symmetrical in nature, i.e it can be removed from the framework and erected at the opposite end if necessary as shown by dashed lines in FIG. 10.

That section of the framework (38) shown between the water jetting section 30 and the rear linear drive section 34 comprises a compartment for housing the distribution headers for high pressure water and hydraulic fluid.

FIG. 11 is a side elevation view of the hydrocleaning assembly 12 showing the framework 36, water jetting section 30, linear drive sections 32 and 34 and compartment 38 in further detail. The bridle assembly 22 is also illustrated here in further detail and as noted previously this bridle 22 can be moved from one end to the other of the assembly if necessary. The jetting modules are not shown in FIG. 11 and will be described in further detail hereinafter.

The overall arrangement of the framework 36 is such that it surrounds a portion of the pipeline when in use and defines a longitudinal passage through which the pipeline extends. The framework comprises a number of parts as illustrated in FIG. 11, which parts include three spaced apart parallel divider plates 40. Also included are a pair of linear drive frame assemblies 42 located at the forward and rear ends of the assembly as described previously. Also included are four spaced apart water jetting frames 44 located in the water jetting section 32 and in spaced apart relationship to one another around the position occupied, during use, by the pipeline, such water jetting frames 44 extending between a pair of the divider plates 40 and bolted thereto. Also included is top deck assembly 46 extending between the fore-and-aft divider plates 40 as well as a bottom support 48 which also extends between a pair of the fore-and-aft divider plates 40. Positioned above the top decking 46 is a hoisting frame 50. The previously noted debris and water collection tray 52 is located at the bottom of the water jetting section 30 and can be readily removed therefrom for cleaning etc. This tray has a central outlet 54 through which water and debris passes. The previously noted side ladders 56 are bolted to the framework outwardly of opposing sides of the compartment section 38 and these ladders 56 enable operating and maintenance personnel to gain access to the various components of the hydrocleaning assembly as required.

It might be noted here that the tray 52 is an option for collection and disposal of debris (removed pieces of coatings) and associated water, if necessary. The outlet 54 may be hooked to any suitable system designed for reclamation and filtration of the water for reuse and for ease of debris disposal.

A hydraulic distributor 60 in compartment 38, adjacent the upper end of same, comprises a panel or box to which is attached all incoming or outgoing hoses for hydraulic fluid and high pressure water. This arrangement makes it easier for a man to climb one of the ladders 56 and to have access to all of the lines or hoses in one place.

It should be kept in mind that the framework 36 is sized in accordance with the size (outside diameter) of the pipeline which is being cleaned. In other words, any one framework 36 can accommodate only one range of pipeline sizes between about 12" and 60" outside diameter. The probable size ranges are as follows:

1. 12" to 16" (NOM.) OD
2. 16" to 20" (NOM.) OD
3. 20" to 24" (NOM.) OD
4. 24" to 30" (NOM.) OD
5. 30" to 36" (NOM.) OD
6. 36" to 42" (NOM.) OD
7. 42" to 48" (NOM.) OD
8. 48" to 54" (NOM.) OD
9. 53" to 60" (NOM.) OD

Thus, nine different models of hydrocleaning assembly would be required in order to enable cleaning of any pipeline from 12" nominal OD to 60" nominal OD.

The water jetting section 30 comprises a plurality of standardized water jetting modules 62 each mounted to a respective one of the water jetting frames 44, the latter, in turn, being mounted between an associated pair of divider plates 40. These water jetting modules 62 are located, with fairly even spacing, around the circumference of the pipeline and they are arranged so that in use they are evenly spaced radially with respect to the pipeline's outer surface.

FIG. 13 is a cross-section view through the water jetting section 13 and showing a four-module array. The four modules are labelled 62A through 62D. The drawing shows two water jets from each of the modules impinging on the outer surface of a 36" OD pipeline. This illustrates the typical operational situation of all four modules. Each pair of jets is rotating around a radial axis which extends through a rotary seal and, at the same time, all of the jet heads are moving parallel to the axis of the pipeline.

Module 62D shows in detail how the jet heads 64 can be adjusted and set in any radial position. Three positions, numbered 1, 2 and 3, are shown in FIG. 13. Position 1 is the same relative radial position as is shown for modules 62A, 62B and 62C. Position 2 shows that the whole module (comprising jet head 64, a rotary seal, hydraulic drive motor and transmission case) has been adjusted radially outwardly by repositioning the flange bolts into different bolt holes in the frame 44. The holes are drilled along a line parallel to the axis of jet head rotation. Position 3 shows the arrangement used for a smaller pipeline, i.e. one having a 30" OD. The jet heads 64 can be moved radially inwardly by repositioning the four flange bolts and/or by extending the axial length of the jet head. For a 30" diameter pipe instead of a 36" diameter pipe, the two equal arm lengths of the jet head 64 can be reduced to adjust the distance between the two nozzles. The shorter arms are shown in position 3 and the radially extending arm nipples are correspondingly shortened.

The jet heads 64 shown in FIG. 13 each include a centrally disposed tee 66, into the center of which is threaded an extension nipple 68. Extension nipple 68 carries high pressure water from the rotary seal (to be described below). The tee 66 has a pair of oppositely extending legs into which are threaded the opposing arm nipples 70. To the outer ends of the arm nipples are threadedly secured 90° elbows 72. The elbows 72 each include a nozzle 74, nozzles 74 being threaded into the elbows 72 so that they can be removed for cleaning or replacement as desired. The arm nipples 70 can be removed and replaced with arm nipples of greater or lesser length thereby to provide the required arm lengths as outlined in further detail below.

The length of the arms of each jet head 64 determines the extent of the area of cleaning covered by the jets from each jet head 64. The areas cleaned by adjacent jet heads 64 need to overlap slightly so as to achieve complete cleaning. The arm lengths chosen for a four module array would have to approximate the length of the "quarter chord" (a chord joining the ends of the arc which equals in length one quarter of the circumference). Because the droplet stream in an individual water jet expand as the jet gets further from the nozzle exit, the cleaning kerf in the pipeline coating resulting from the jet's action will be wider the further the nozzle is away from the pipe's surface. Therefore, to achieve sufficient overlap of the cleaning areas of adjacent jet heads the arm length distance between nozzles 74 can be slightly less than the "quarter chord" length. This can be determined by trials of various arm lengths under field operating conditions.

FIG. 13 also illustrates typical components of a jet module 62. The various components of the jet module need not be described in detail due to the fact that there are a number of commercially available types of rotary swivels and drives designed and built for ultra high pressure rotary water jetting in the 20000–35000 psi range. FIG. 13 shows one typical arrangement. The rotary swivel 80 seals on an output shaft 88 which is driven through a driven gear by a driving gear (gears not shown) on a shaft rotated by a hydraulic motor 82. These gears are contained in a transmission case 84. The transmission case is provided at one end with a flange 86 of rectangular outline, such flange having four bolt holes to enable attachment of the water jetting module to the previously described frame 44 at the radial position desired as described previously. The rotary swivel 80 is provided with a threaded nipple 86 to provide for connection to a high pressure water hose. The rotary swivel output shaft 88 is internally threaded to receive the extension nipple 68 of the previously described jet head 64. The hydraulic motor 82 is provided with inlet and outlet ports for hydraulic fluid, the hydraulic fluid supply arrangement to be described hereinafter. The rotary swivel 80 defines an axial water passage. This passage branches in the tee 66 of the jet head 64, passing through the two arms and then turning through the two elbows and passing through the jet nozzles 74. As described previously, the axis of each nozzle 74 is at or very near 90° to the arms and thus these nozzles direct water at or near 90° to the pipeline axis.

Jet module arrangements substantially as described above are commercially available from a number of different manufacturers. One such manufacturer is ADMAC, Incorporated, of Kent, Wash., U.S.A., particularly Model No. 2420 "HIGH FLOW SWIVEL". Other ultra high pressure water jetting rotary swivels are available from: NLB CORP., WIXOM, MICH. U.S.A. ("SPIN JET", MODEL 1100); BUTTERWORTH Jetting Systems Inc. of Houston, Tex., under the "Swivel Jet" and "BUTTERWORTH" trademarks and others to be noted hereafter.

In FIGS. 14 and 15 in particular, there has been indicated the water inlet, 86 and hydraulic fluid inlet and outlet ports, 90 for a water jetting module 62.

As far as possible, the high pressure water lines are piped in such a way as to provide equal and also minimal line pressure losses. As an example, for four jetting modules 62, the high pressure water line has two branches in rigid or "hard" piping fixed to and passing through a hole in the divider plate for branches T1, T2 and T1, T3. From there, flexible hoses 92 from T2 and T3 to the inlet 86 of the rotary swivel 80 will allow sufficient freedom of movement of the module 62 during the radial adjustments described previously. A typical high pressure water supply diagram for four jet modules 62 is illustrated in FIG. 14. As noted above, branches T1, T2 and T1, T3 are of hard or rigid piping while branches from T2 and T3 extending to the inlets of the rotary swivels 80 are flexible hoses to allow the radial adjustments described previously. Balanced pressure losses are provided by arranging for the water to pass through the same number of fittings (e.g. tees and elbows) in each portion of the water supply.

Referring to FIG. 15, the hydraulic lines 94 are shown in series to and from each hydraulic motor 82 of each of the water jetting modules 62. All of these lines may comprise flexible hoses. To provide a tidy arrangement, each hose can be fastened against the adjacent divider plate 40 and routed around generally in a circle. The two main inlet and outlet hydraulic lines 96, 97 are arranged to pass through the adjacent divider plate 40 into the compartment 38 where central distribution headers (not shown) are suitably housed. Previously noted elongated flexible hoses and lines 28 connect these headers to the water and hydraulic fluid pumps through the control valves (not shown) that are housed remotely from the hydrocleaning assembly 12 in the control system 14. These connections would be arranged for easy connection and disconnection at compartment 38. The bundle of hoses could then be swung away and stored on the ancillary equipment upon disconnection.

The linear drive sections of the hydrocleaning apparatus will now be described with particular reference to FIGS. 11 and 12. In general, the linear drive arrangement comprises a plurality of drive wheels (crawler wheels) which are powered through a constant speed reducer by hydraulic motors. Drive wheel rotational speed is set by controlling the rate of hydraulic fluid flow through the motor or motors in accordance with known techniques.

The drive crawler wheels 100 and the idler wheels 102 are mounted in the fore-and-aft linear drive sections 32, 34 as shown in the drawings. Drive crawler wheels 100 are mounted to spaced apart support brackets 104 (FIG. 12) while the idler wheels 102 are mounted to spaced apart support brackets 106. The drive crawler wheels 100 ride on the top half of the pipeline while the idler wheels 102 contact the lower half. Both sets of wheels straddle the vertical plane that passes through the axis of the pipeline. This means that while sitting or rolling on the pipeline, the total weight of the hydrocleaning assembly 12 is acting on the drive crawler wheels 100. The drive crawler wheels 100 are fitted with solid urethane tires whose tracking surface is cut to a bevel to approximately match the pipelines contour. The traction between the coated or uncoated (cleaned) pipe surface is sufficient to get the entire assembly moving and to maintain a steady linear speed.

The idler wheels 102 are shimmed upwardly by shims 108 disposed below the brackets 106 so that the idler wheels 102 contact the pipe's surface thus serving to steady and to guide the hydrocleaning assembly.

The crawler wheels 100 are mounted to a threaded shaft 110. The crawler wheels 100 include a central hub which is internally threaded for adjustment of the length L between the crawler wheels. Lock nuts are tightened against opposing ends of the crawler wheels 100 to secure them in position on the threaded shaft 110. Each end of threaded shaft 110 is keyed to accommodate a sprocket as necessary. The length L and bevel angle Q are varied to fit the particular pipeline involved. Gear reduction units 120 (See FIG. 11) are mounted on the upper portions of the fore-and-aft linear drive frames 42. These reduction units 120 are provided with an output shaft and a sprocket 122, (See FIG. 12) such drive sprocket 122 being connected via a drive chain 124 and to a further sprocket 126 mounted to the end of the above described shaft 110. The opposing end of shaft 110 is provided with a further sprocket 128 which, in turn, is connected via a drive chain 130 to a sprocket 132 secured to the second shaft 110 so that both sets of drive crawler wheels 100 are driven in unison. The gear reduction units 120 are powered by hydraulic motors 119 of conventional construction.

In order to increase the linear drive traction, an alternative arrangement (not shown) can be used to convert the front idler wheels to drive wheels which are chain driven from the same reduction units 120. This wheel would be forced upwardly against the pipe using springs or a hydraulic actuator. Similar systems are currently well known in the art and in some brochures they are referred to as "mountain climbers".

Linear drive is possible in either direction. To reverse the direction, the flow through the hydraulic motors 119 is reversed using suitable valving (not shown).

For rapid travel when the hydrocleaning assembly is not being used to clean the pipeline, all water and hydraulic lines can be readily disconnected. The drive chains to the drive crawler wheels 100 are easily disconnected and then the unit is towed along the pipeline using the side boom tractor 16 at a speed of 5 to 6 miles per hour.

OPERATION OF THE FIRST EMBODIMENT

For any given size of pipeline the number of jetting modules 62 is chosen and the jetting frames 44 built and located accordingly. The correctly sized framework 36 is assembled around a short piece of the same size pipe in the shop. The wheels 100, 102 are shimmed, the unit is centred, and then the jetting modules and jet heads are attached. These are set at the desired stand-off position (as determined by some trial and error experiment, depending on the coating to be removed). The water and hydraulic lines are hooked up and the unit is then shop tested. The operators' parameters are chosen depending on the type and thickness of coating to be cleaned.

The hydrocleaning unit is transported to the field still assembled and centred around the short pipe. The short pipe is butted up against the pipeline to be cleaned and rigidly aligned using a conventional pipe alignment device which is inserted on the inside at the joint. The hydrocleaning assembly is connected up hydraulically and then driven on to the coated pipe. The coated pipe is then ready to be cleaned. The hoisting frame is used when lifting the unit for transportation and pipe alignment.

An operator standing at the controls 14, which are packaged together with the pumps and power source unit 24, can regulate line speed hydraulically and can turn water on and off to the jet heads 64. The water pressure to each individual jet head 64 is remotely indicated at the operator station. The operator makes sure that any loss of linear travel immediately results in water shut down. (This should be automated for safety.)

The operator of the side boom tractor 16 walks his vehicle along parallel to the line while holding the pipe off the ground high enough for the hydrocleaning assembly to be clear while travelling at the same speed as the assembly so as to keep the fluid hoses 28 from being fully extended. The distance between his line of travel and the pipeline is maintained so that the fluid hoses 28 are not unduly extended or kinked.

The hoist cable from the side boom 18 passes through the bridle 22 and it supports the full weight of the pipeline by means of the cradle. The cable allows minimal circumferential motion of the hydrocleaning assembly 12, by virtue of the bridle's arms. Thus, stability is maintained.

By keeping the hoist cable axial position inside the bridle 22 fairly constant the operator ensures that the cradle will not hit the hydrocleaning assembly 12. A chain joining the two arms of the bridle keeps the hoist cable confined. If the hoist cable touches and tensions this chain then the side boom is actually pulling the assembly 12 along the pipeline. This should be avoided if constant linear speed is to be precisely controlled.

It is necessary to use filtered water when using ultra high pressure water (20–35 ksi) to reduce plugging and abrasion. The water should be treated to ensure against flash rusting of the cleaned steel surface by using a suitable inhibitor. The water can be drawn from a clean source and transported to the field water supply tank 26 by tanker truck.

To ensure adequate safety the operator should be able to retain full vision of the hydrocleaning assembly from his control station and should be able to activate an immediate and total shut down of the system from the control station if conditions so require.

THE SECOND EMBODIMENT

It was noted previously that in many cases pipeline operators prefer to remove the old coatings of their pipeline "in situ". This means that they would not cut the line after excavating and would not lift it above ground. Instead they would simply excavate beside and beneath the line and then, with oil and/or other liquid products still inside the line, would remove and replace the old coating. (For safety, however, the internal line pressure would be considerably reduced.) The line is typically supported ahead and behind the moving machine by wooden blocks called "skids". Accordingly, the second embodiment of the invention illustrated in FIGS. 16–26 is specifically adapted for "in situ" hydrocleaning. This machine can be "opened" and fitted down over the pipe line and then closed so that the jet heads are all reasonably evenly arranged circumferentially and radially around the pipe's surface. The first embodiment of the invention described above did not have such a feature; it had to be fitted over the end of a cut line. The second embodiment can easily be removed from the line by reversing the actions above described.

The several pieces of supporting equipment for the second embodiment are much the same as described previously in connection with FIGS. 7–10 and need not be presented here. Hence, the water supply, hydraulic fluid and control systems and the like will not be described further.

The hydrocleaning assembly 200 of FIGS. 16–26 is designed so that the four water jetting modules 210 (including the jet head drive assemblies) are, when the machine is in the "closed" operating condition, approximately evenly spaced around the pipe circumference as best seen in FIG. 17. When water jetting (hydrocleaning) is underway and the pipe is being cleaned the whole assembly, including support frame 212, is driven along the pipe by four frame-mounted spaced-apart traction drive assemblies 220 (two in front and two behind) each having a drive wheel 222 driven by a hydraulic motor 224 via chain and sprocket means 226. Diagonally opposite each of the four drive wheels are four idler wheel assemblies 228 of equal diameter that are compressed on the pipe surface by the action of four hydraulic cylinders 230 (which act on the hinged frame 212 as described hereafter). The hydraulic system exerts sufficient force so as to prevent drive wheel slippage on slippery muddy coatings or when attempting to climb steep hills. The hydraulic system exerts sufficient force so that the drive will be effective even if one or two drive wheels should spin out or lose pipe contact. The compressive force on the wheels can be set at any reasonable level using a conventional hydraulic control valve. A conventional pre-charged accumulator cushions any radial motions of the wheels which may be caused by pipe size or profile variations.

To drive each drive wheel each hydraulic motor 224 is mounted to a 87:1 gear box 223 which then drives the associated wheel 222 through the chain and sprocket 226 all these components being well known per se.

The support frame 212 is built so as to allow the positioning of the drive wheels 222 and the idler wheels 228 in a symmetrical four point arrangement as best seen in FIG. 17. Also, the frame 212 has brackets which locate the positions for linkage of the four water jetting modules 210 to the frame so that there is approximately 90 degrees between each jet head rotary axis and so that these axes in use are normal to the pipe's surface and intersect at the pipes axis at approximately 90 degrees as further described hereafter.

The support frame 212 is made of sturdy tubular members welded together to provide the necessary strength and rigidity. Frame 212 includes a top frame section 236 comprising two top frame arm sections 239 rigidly connected together at 90 degrees to each other and to the lower outer edges of which are hinged the bottom frame arm sections 238 as described below.

The top frame section 238 has four hinges 240 (two in front, two behind) about which the two bottom frame arm sections 238 can be rotated by the working action of the four hydraulic cylinders 230 previously noted. The two bottom frame arm sections 238 are the "doors" of the machine. When opened to approximately a vertical position (see FIG. 18) the machine can easily be lowered downwardly and placed over or lifted upwardly and taken off the pipe. This important feature is required for "in situ" work.

The top and bottom frame arm sections 236 and 238 are each provided with a bracket which co-operates with a multi-hole adjustment bracket 244 by which each water jetting module 210 is attached to the frame. The holes in the frame bracket align with the holes in the adjustment bracket 244 such that the bracket 244 can be moved radially in or out to accommodate the various pipe diameters. Thus, a suitably wide range of pipe diameters can be handled by the same machine.

Similarly, the drive and idler wheel assemblies 220 and 228 can be moved inward or outward radially to accommodate the various pipe diameters by locating two pins which extend through respective frame brackets in different pairs of holes in multi-hole adjustment brackets 248 affixed to each of the drive and idler wheel assemblies 220, 228.

As noted previously, rotation of the jet heads 276 above the surface of a large steel pipe requires maintaining consistent, safe, jet-head to pipe spacing despite variations in pipe diameter, (these can be up to 1% of diameter), out of roundness, dents and wrinkles in the pipe's surface. If not, serious damage can result. In order to achieve this, each water jetting module 210 is supported from the support frame 212 by means of a special hinged arrangement, i.e. a four bar linkage, that ensures that the module 210 can move in a radial direction but will always stay in a constant alignment with respect to the pipe's axis. At the same time a hydraulic cylinder/accumulator system (well known per se in the art) maintains a compression on a guide wheel having a screw-jack height adjustment which fixes the module and rotary jet head to pipe clearance. Thus the rotating head will maintain a fixed relationship to the pipe's outer surface despite diametral dimension variations and surface deformations that may be encountered. If one compares this to the structure described as the first embodiment, it will be obvious that this system eliminates risk of a "crash" and greatly facilitates making clearance adjustments.

Thus, as shown most clearly in FIGS. 19, 20 and 23, each water jetting module 210 is attached to its respective frame arm section by an associated four bar parallel arm linkage 250. Each linkage 250 is connected to its associated adjustment bracket 244 at spaced pivot points 252 and to a side link 254 such that side link 254 is maintained at 90 degrees to the pipe's axis at all times. The frame 256 of each water jetting module 210 is bolted to a respective one of the side links 254 (see FIGS. 19, 20, 23 etc.). Hence as the parallel arm mechanism is moved, the module 210 moves inwardly and outwardly.

A hydraulic cylinder 260 is secured to the support frame members by a suitable bracket and pin 262 and each cylinder has its ram connected at 264 to the linkage 250 to raise and lower the associated jetting module 210 into raised and working positions respectively as illustrated in FIGS. 19 and 20 for example.

When the module 210 is lowered a guide wheel 268 which is mounted to frame 256 via pivot link 270 contacts and presses on the pipe. This helps to stabilize the whole module as it moves along the pipeline. The clearance between the jet head 276 and pipe can be easily adjusted by means of the wheel jacks 272 which comprises threaded adjustment bolts 274 cooperating with threaded pivots 276 secured to frame 256 and the guide wheel mounting links 270.

The front guide wheels 268 are meant to contact the pipe at all times. The rear guide wheels however can be set up to clear the pipe by approximately the thickness of the coating after the coating has been cleaned off. The rear guide wheel 268 is there mainly for insurance should the front guide wheel move radially inward more than the coating thickness due to its falling into a depression or dent in the pipe.

In operation, then, each water jetting module 210 is held essentially stationary with respect to the support frame 212 by the parallel arm linkage 250 and against the pipe by the force transmitted through the guide wheel 268 by the hydraulic cylinder 260. When the guide wheel 268 (the front one) is moved out radially by a bump in the pipe then the whole module 210 moves outward at the same time and the gas in the accumulator (not shown) which is connected in the hydraulic circuit is compressed thus cushioning the motion.

Referring to FIG. 23, the jet head 276 is driven by a sprocket 280 and belt drive assembly 282. The driver sprocket 284 is powered by a hydraulic motor 286 such as a Sundstrand-Sauer TKM200 through an overhung load adapter 288 e.g. a Helland Model 200. The driven sprocket 280 is keyed to the shaft 290 which is supported radially and vertically in two bearings in the drive housing 292.

The water jet head 276 is connected to an incoming water line at the inlet 300 to the swivel 302. The swivel 302 is screwed into a shank 304 and the shank seats down inside the shaft. The shank is drawn down on the conical section in the shaft by the nut 306 which is coned to match the coned bottom of the shaft.

The shank 304 extends beyond the nut 306 and the water inside branches one or more ways (depending on whether one nozzle outlet is blocked) from the shank 304 through the shank wall and into the attached swing arms 310 of jet head 276. The swing arms 310 are made of high pressure tubing bent 90 degrees to screw into each nozzle housing 312. A nozzle 314 is fitted into each nozzle housing. The tubing arms 310 are usually male coned at the shank end so as to match the female cone in the shank. A collar is screwed on the tubing and the collar and tubing are drawn towards and into the shank cone by a gland nut. (These details are not shown as this is a conventional method for connecting high pressure fittings.)

Around the arms 310 is fitted a paddle 320 typically made of heavy sheet metal folded down and around both sides of both arms which serves to:

(i) support the arms 310 from working loose and from excessive deflection due to back thrust forces at the jet exit.

(ii) prevent coating debris entanglement of the nozzles and arm.

(iii) create a pumping action to eject air, water and debris from the shroud 322.

Surrounding the paddle 320 and arms 310 of the jet head is a fixed shroud 322. It is fixed by bolts and brackets 324 to the water jetting module frame 256. It acts as a housing within which the paddle 320 rotates and directs the exit of coating debris and water through its side outlet 324 FIGS. 21 and 22 . The lower edges 326 of metal shroud are contoured to fit fairly close to the pipe but not to contact it when the water jetting module is in the lowered position (FIGS. 17 and 19). A flexible rubber seal (not shown) may be fitted to the shroud 322 to contact the pipe so as to most effectively contain the coating debris from falling on top of the pipe behind the machine.

As noted previously, many lines were coated in the past with some materials which are environmentally unacceptable, for one reason or another. In some instances these materials cannot be simply buried with the line or dumped on the ground after they have been removed with the water jets. The means provided for containment and disposal of such waste material produced by the hydrocleaning process is to enclose the whole machine with a canopy 350 (FIGS. 16, 17 and 18) of suitable light material with a catchment sump 352 beneath the machine. From the sump 352 the slurry of water and coating debris can be pumped to disposal tankers using suitable vacuum pumps. In some cases the possibility exists for separating most of the water and cleaning it of solids and reusing it, for hydrocleaning the pipeline.

The sump 352 can be hung from the frame as shown or alternately it may be dragged along the right-of-way beneath the pipeline and immediately beneath the machine to effectively catch all the water and debris. Suitable runners would be welded beneath the sump for ease of motion on rough terrain.

It has been previously noted that a pipeline operator has to excavate earth so as to expose the total circumference of the line in place with sufficient annular clearance beside and beneath the line for subsequent movement of the hydrocleaning machinery. However, with some oil or gas products in the line under pressure the use of a back hoe or the use of ditch scoops on a continuous ditch excavating machine could be dangerous should the pipe be impacted by such moving equipment. FIG. 27 shows a typical reasonably safe excavation which would have residual earth still to be removed from around the pipe.

FIG. 26 illustrates a modification of the second embodiment for washing away the residual earth from around the pipe. This involves the use of the hydrocleaning machine as an earth excavator by providing auxiliary rotary jet heads 360, constructed and driven as before but located to direct the water jets generally in a direction ahead of the machine and obliquely against the pipeline surface to thus wash the earth residue from the line. The jet heads 360 are located and rotated so as to achieve total coverage of the pipeline surface to be washed.

Alternately, a separate assembly could be used strictly for excavating earth.

With continued reference to FIG. 26, the support frame for the jet head drive is attached at a suitable angle "A" as shown and so the jets can be directed to wash earth from, on and around the pipe which is left after most of the trench has been excavated.

The swing arms on the jet heads 360 have been modified from that described previously to angle the nozzles outward from the axis of rotation in order to more effectively impact the earth wall that is immediately ahead of the jets. While rotating, any one jet is cutting some earth and washing the pipe's surface with every revolution. Suitable hydraulic cylinders could be used to make "angle A" adjustments to suit local conditions. Other than for the above, the overall hydrocleaning machine remains the same so further details are not shown.

Operation of the Second Embodiment

After the pipeline has been excavated, the hydrocleaning assembly, with bottom frame arm sections 238 "open", as seen in FIG. 18, is lowered downwardly onto the pipeline so that the drive wheels 222 engage the pipe surface. Hydraulic cylinders 230 are then activated to "close" the bottom frame arm sections 238 and the cylinders 260 are activated to move the water jetting modules 210 inwardly into close proximity to the pipeline surface (eg. FIGS. 17 and 20). Hydraulic fluid is supplied to motors 224 to cause the machine to advance along the pipe and hydraulic motors 286 are also activated to effect rotation of the jet heads 276. Pressurized water is supplied as described before to the rotating jet heads so that the hydrocleaning of the pipeline surface can commence. Removed coatings etc. are caught by the canopy and pumped out of the sump. If a small obstruction is reached, the modules 210 can be moved radially outwardly by cylinders 260, until the machine moves past the obstruction; if a large obstacle is encountered the whole apparatus can be lifted clear of the pipeline and moved past the obstruction by opening the frame etc. as described previously. If the water jet excavating and cleaning system of FIG. 26 is being used, the auxiliary rotary jet heads 360 will also be activated as required to wash away residual earth from around the line. If the excavating and cleaning apparatus of FIG. 26 is constructed as a separate machine which is only capable of washing residual earth away from around the pipeline, such machine will precede the main hydrocleaning machine along the pipeline. Once the earth has been removed from the pipeline surface, the main hydrocleaning assembly can be used to remove coatings etc. as previously described. Other operational details will be readily apparent from the descriptions given above and need not be outlined in detail here.

We claim:

1. Apparatus for cleaning an exterior surface of a pipeline comprising:

(a) a frame defining a longitudinal passage therethrough of a size sufficient to accommodate the pipeline whereby said pipeline is able to pass longitudinally through said frame;

(b) a plurality of jet modules mounted to said frame in spaced apart relation, each of said jet modules including at least one rotatable liquid jet nozzle, said jet modules circumferentially spaced about said longitudinal passage, each of said rotatable jet nozzles directed toward said pipeline to produce a liquid jet that traces a substantially circular path on the surface of said pipeline, wherein said jet modules are spaced so that said liquid jet paths overlap to provide complete circumferential cleaning of said pipeline exterior surface; and (c) lines for supplying high pressure liquid to said jet nozzles to cause said liquid jets to be emitted from said jet nozzles.

2. Apparatus according to claim 1 wherein said jet nozzles rotate about rotation axes which are generally normal to the pipeline exterior surface, and each of said jet modules including a drive device for effecting the rotation of said jet nozzles.

3. Apparatus according to claim 1 further comprising at least one support roller mounted on said frame whereby said support roller is adapted to roll along the exterior surface of said pipeline and support said apparatus on said pipeline.

4. Apparatus according to claim 3 wherein said support rollers are mounted on said frame to engage the pipeline surface at circumferentially spaced apart intervals, said apparatus further including a support roller drive device for rotating said support rollers whereby said pipeline is moved relative to apparatus.

5. Apparatus according to claim 1 wherein said jet modules are adjustably mounted to said frame whereby the radial spacing of said modules relative to the pipeline diameters and to provide a desired spacing between the pipeline surface and said nozzles.

6. Apparatus as in claim 1 wherein said means for supplying high pressure liquid comprises a high pressure pump means and a prime mover, water storage means and flexible hose means connected between said pump means and said nozzle means to supply the high pressure liquid thereto.

7. Apparatus as in claim 6 wherein said high pressure pump, prime mover and water storage means are mounted to means capable of travelling alongside the pipeline.

8. Apparatus as in claim 1 including means connected to said frame and supported from the ground, when in use, for preventing rotation of said frame around the pipeline during the relative movement between the frame and the pipeline surface.

9. Apparatus according to claim 1 wherein said frame comprises a plurality of interconnected sections wherein at least one of said frame sections can be moved between an open condition and a closed condition whereby said apparatus can be fitted about a pipeline when said frame is in said open condition.

10. Apparatus according to claim 9 wherein said at least one frame section is pivotally mounted to said frame for pivotal movement relative thereto, said apparatus further including an actuator power source for effecting pivotal movement of said frame between said open condition and said closed condition.

11. Apparatus according to claim 10 further including at least one support roller mounted on said frame and at least one idler wheel mounted on said frame whereby said support rollers and said idler wheels engage said pipeline when said frame is in said closed condition and whereby said support rollers and said idler wheels are mounted on said frame in an opposed relationship so as to engage said pipeline therebetween.

12. Apparatus according to claim 11 wherein said actuator power source exerts a biasing force on said support rollers and said idler wheels when said frame is in said closed condition whereby said support rollers and said idler wheels are forced radially inwardly into generally tight engagement with the pipeline surface to allow sufficient tractive force between said support rollers and said pipeline.

13. Apparatus according to claim 1 including respective linkage connecting each said module to said frame, a guide wheel mounted to each said module for contacting the pipeline surface during movement there-along, said linkage being arranged to permit each said module to move generally radially inwardly or outwardly relative to the pipeline surface to maintain a preselected spacing between each said jet nozzle and the pipeline surface during use as said guide wheel rolls on said pipeline surface.

14. Apparatus according to claim 13 wherein said linkage comprises a parallel arm linkage capable of maintaining a selected orientation of each said module relative to the pipeline surface during said radial motion.

15. Apparatus according to claim 13 including an actuator associated with each said linkage for (a) moving said modules toward or away from the pipeline surface and (b) maintaining a biasing force urging the guide wheel toward the pipeline surface so as to follow any irregularities therein.

16. Apparats according to claim 15 including screw adjustment means associated with said means to adjust the distance between the jet nozzle means and the pipeline surface.

17. Apparatus according to claim 1 including a shroud surrounding each jet module.

18. Apparatus according to claim 1 further including a containment shroud surrounding the apparatus for catching debris and a catchment sump disposed below said apparatus for receiving water and debris removed by said apparatus after cleaning liquid has impacted the pipeline exterior surface.

19. Apparatus for cleaning an exterior surface of a pipeline comprising:

(a) a frame defining a longitudinal passage therethrough of a size sufficient to accommodate the pipeline whereby said pipeline is able to pass longitudinally through said frame, (b) a plurality of jet modules mounted to said frame to permit relative motion with respect to said frame, each of said jet modules including at least one rotatable liquid jet nozzle, said jet modules circumferentially spaced about said longitudinal passage, each of said rotatable jet nozzles directed toward said pipeline to produce a liquid jet that traces a substantially circular path on the surface of said pipeline, (c) a respective guide for each of said jet modules, each said guide mounted to the corresponding jet module and extending toward said longitudinal passage for contacting the surface of said pipeline wherein each said guide holds the corresponding module at an essentially fixed distance away from the surface of said pipeline, and (d) lines for supplying high pressure liquid to said jet nozzles to cause said liquid jets to be emitted from said jet nozzles.

20. The apparatus according to claim 19 further comprising a plurality of support rollers mounted on said frame whereby said support rollers contact said pipeline, and further comprising a support roller drive device for providing rotational movement to said support rollers whereby said pipeline is caused to move longitudinally with respect to said apparatus.

21. The apparatus according to claim 19 wherein said nozzles are mounted to said respective jet modules frame for rotation about rotation axes normal to the pipeline exterior surface, said apparatus further comprising means for effecting the rotation of said nozzles.

22. The apparatus according to claim 19 wherein each of said jet modules further comprising a shroud surrounding the corresponding jet nozzles.

23. The apparatus according to claim 19 further comprising a containment housing surrounding said apparatus such that said containment housing catches debris and cleaning liquid after said liquid has impacted upon applying exterior surface.

24. An apparatus for cleaning an exterior surface of a pipeline, comprising:

a frame defining a longitudinal passage therethrough of a size sufficient to accommodate said pipeline whereby said pipeline is able to pass longitudinally through said frame; at least one linkage mechanism mounted on said frame; at least one jet module mounted to said linkage mechanism, each said jet module including a liquid jet nozzle mounted for rotational movement wherein said nozzles are able to direct jets of cleaning liquid toward said pipeline surface, at least one guide wheel mounted to each of said linkage mechanisms whereby said guide wheel contacts said pipeline surface and causes the corresponding linkage mechanism to adjust the position of the corresponding jet module with respect to said frame to maintain an essentially fixed distance between said jet module and the surface of said pipeline, and lines for supplying high pressure liquid to said jet nozzles to cause said liquid jets to be emitted from said jet nozzles.

25. The apparatus according to claim 24 further comprising a plurality of support rollers mounted on said frame whereby said support rollers contact said pipeline, and further comprising a support roller drive device for providing rotational movement to said support rollers whereby said apparatus is caused to move longitudinally with respect to said pipeline.

26. Apparatus for cleaning an exterior surface of a pipeline comprising:

(a) a frame defining a longitudinal passage therethrough of a size sufficient to accommodate the pipeline whereby said pipeline is able to pass longitudinally through said frame, said frame comprising a plurality of frame sections and at least one of said frame sections pivotally connected to another one of said frame sections, (b) a plurality of jet modules mounted to said frame in spaced apart relation, each of said jet modules including at least one rotatable liquid jet nozzle, said jet modules circumferentially spaced about said longitudinal passage, each of said rotatable nozzles directed toward said pipeline to produce a liquid jet that traces a substantially circular path on the surface of said pipeline, (c) an actuator connected between said frame and said one frame section for driving said one frame section to open and closed positions to permit said apparatus to be placed on said pipeline when said one frame section is in said open position, (d) a wheel mounted to said one frame section for contacting said pipeline surface when said one frame section in said closed position, said actuator for biasing said wheel against said pipeline wherein said one frame section maintains an essentially fixed distance from the surface of said pipeline despite irregularities in said pipeline, and (e) lines for supplying high pressure liquid to said jet nozzles to cause said liquid jets to be emitted from said jet nozzles.

* * * * *

UNITED STATES PATENT AND TRADEMARK OFFICE

CERTIFICATE OF CORRECTION

PATENT NO. : 5,052,423

DATED : October 1, 1991

INVENTOR(S) : Gordon R. Chapman, ET AL

It is certified that error appears in the above-identified patent and that said Letters Patent is hereby corrected as shown below:

Column 19, line 67, insert --exterior surface can be varied to accommodate a variety of pipeline-- before "diameters".

Column 20, line 1, delete "means" and insert --lines--;

line 5, delete "nozzle means" and insert --jet modules--;

line 8, delete "pump," and insert --pump means,--;

line 65, change "Apparats" to --Apparatus--;

line 66, delete "means" and insert --guide wheel--;

line 67, delete "nozzle means" and insert --modules--.

Column 22, line 39, insert --jet-- after "rotatable".

Signed and Sealed this

Twelfth Day of July, 1994

Bruce Lehman

BRUCE LEHMAN

*Commissioner of Patents and Trademarks*

*Attest:*

*Attesting Officer*